US011030842B2

(12) United States Patent
Hashimoto et al.

(10) Patent No.: US 11,030,842 B2
(45) Date of Patent: Jun. 8, 2021

(54) BANKNOTE HANDLING APPARATUS

(71) Applicant: GLORY LTD., Himeji (JP)

(72) Inventors: Shingo Hashimoto, Himeji (JP); Kazuhiko Takahashi, Himeji (JP)

(73) Assignee: Glory Ltd., Himeji (JP)

( * ) Notice: Subject to any disclaimer, the term of this patent is extended or adjusted under 35 U.S.C. 154(b) by 212 days.

(21) Appl. No.: 15/984,453

(22) Filed: May 21, 2018

(65) Prior Publication Data

US 2018/0268636 A1 Sep. 20, 2018

Related U.S. Application Data

(63) Continuation of application No. 14/000,687, filed as application No. PCT/JP2012/054010 on Feb. 20, 2012, now Pat. No. 9,978,197.

(30) Foreign Application Priority Data

Feb. 22, 2011 (JP) ..... 2011-036338
Feb. 22, 2011 (JP) ..... 2011-036345
Feb. 20, 2012 (WO) ..... PCT/JP2012/054010

(51) Int. Cl.
*G07D 11/00* (2019.01)
*G07D 11/12* (2019.01)
(Continued)

(52) U.S. Cl.
CPC ..... *G07D 11/00* (2013.01); *G07D 11/12* (2019.01); *G07D 11/125* (2019.01); *G07D 11/14* (2019.01);
(Continued)

(58) Field of Classification Search
CPC .... B65H 2701/1912; B65H 2301/4314; G07D 11/00; G07D 11/006; G07D 11/0006;
(Continued)

(56) References Cited

U.S. PATENT DOCUMENTS 5,105,364 A * 4/1992 Kawamura ..... G07D 11/245 700/219
5,183,999 A * 2/1993 Hakenewerth ..... G07F 7/06 235/379
(Continued)

FOREIGN PATENT DOCUMENTS

EP 0 940 779 A2 9/1999
EP 2 031 567 A2 3/2009
(Continued)

OTHER PUBLICATIONS

English Abstract for JP 2655779 B2. (Year: 1997).*
(Continued)

*Primary Examiner* — Jeffrey A Shapiro
(74) *Attorney, Agent, or Firm* — Renner, Kenner; Edward G. Greive

(57) ABSTRACT

In a banknote handling apparatus capable of dealing with a depositing/dispensing process by a banknote cassette and a manual depositing/dispensing process, the banknote handling apparatus enables a depositing process without dispensing a reject banknote, which has been deposited from the banknote cassette, to the outside. A banknote accounting apparatus 22 capable of receiving a banknote from banknote feeding units (a banknote receiving unit 201*a*, a banknote cassette 30*a*) includes: a transport unit 230*a* configured such that the banknote feeding unit is connected thereto, the transport unit configured to transport a received banknote; a recognition unit 240*a* configured to recognize the banknote being transported; an apparatus-internal reject unit 224*a* configured to store a reject banknote inside the apparatus; an apparatus-external reject unit 22*a* configured to dispense a reject banknote outside the apparatus; a unit deciding part configured to decide the banknote feeding unit for feeding a banknote; and a control unit configured to decide, when the recognition unit recognizes a banknote having been received
(Continued)

from the banknote feeding unit as a reject banknote, to which one of the apparatus-internal reject unit 224*a* and the apparatus-external reject unit 222*a* the reject banknote is transported, based on the banknote feeding unit having fed the banknote.

10 Claims, 11 Drawing Sheets

(51) Int. Cl.

| | |
|---|---|
| ***G07D 11/14*** | (2019.01) |
| ***G07D 11/25*** | (2019.01) |
| ***G07D 11/30*** | (2019.01) |
| ***G07D 11/50*** | (2019.01) |
| ***G07D 11/125*** | (2019.01) |
| ***G07D 11/245*** | (2019.01) |
| ***G07D 11/60*** | (2019.01) |

(52) U.S. Cl.
CPC ..... *G07D 11/245* (2019.01); *G07D 11/25* (2019.01); *G07D 11/30* (2019.01); *G07D 11/50* (2019.01); *G07D 11/60* (2019.01)

(58) Field of Classification Search
CPC ..... G07D 11/0009; G07D 11/0012; G07D 11/0015; G07D 11/0018; G07D 11/0021; G07D 11/0036; G07D 11/0051; G07D 11/0054; G07D 11/0057; G07D 11/0066; G07D 11/0084; G07D 11/12; G07D 11/125; G07D 11/13; G07D 11/135
USPC ..... 194/206, 207; 209/534; 382/135; 235/379
See application file for complete search history.

(56) References Cited

U.S. PATENT DOCUMENTS

| | | | | | |
|---|---|---|---|---|---|
| 6,036,089 | A * | 3/2000 | Oguchi | G07F 19/20 | 235/379 |
| 6,065,672 | A * | 5/2000 | Haycock | G07D 11/34 | 235/379 |
| 6,640,156 | B1 * | 10/2003 | Brooks | G07D 11/40 | 700/213 |
| 6,796,434 | B2 * | 9/2004 | Kako | B65H 7/02 | 209/534 |
| 7,841,459 | B2 * | 11/2010 | Isobe | B65H 29/46 | 194/206 |
| 2004/0150158 | A1 * | 8/2004 | Biegelsen | B65H 5/062 | 271/303 |
| 2005/0078864 | A1 * | 4/2005 | Amari | G07D 11/0021 | 382/135 |
| 2006/0012114 | A1 * | 1/2006 | Ko | B65H 29/20 | 271/315 |
| 2007/0000993 | A1 * | 1/2007 | Graef | G07F 1/041 | 235/379 |
| 2009/0166957 | A1 * | 7/2009 | Kong | B65H 31/3009 | 271/198 |
| 2010/0198396 | A1 * | 8/2010 | Brexel | G07D 11/25 | 700/219 |
| 2011/0132718 | A1 * | 6/2011 | Park | G07F 19/20 | 194/206 |
| 2011/0133389 | A1 * | 6/2011 | Nemoto | B65H 3/5261 | 271/10.09 |
| 2012/0282073 | A1 * | 11/2012 | Fehrenbach | G06Q 20/1085 | 414/788.1 |

FOREIGN PATENT DOCUMENTS

| | | | | |
|---|---|---|---|---|
| JP | 62-167135 | A | 7/1987 | |
| JP | 62-204397 | A | 9/1987 | |
| JP | 2655779 | B2 * | 3/1992 | G07D 9/08 |
| JP | 2000-306145 | A | 11/2000 | |
| JP | 2002-145462 | A | 5/2002 | |
| JP | 2007-34522 | A | 2/2007 | |
| JP | 2010-33218 | A | 2/2010 | |
| JP | 2012-174063 | A | 9/2012 | |

OTHER PUBLICATIONS

English Machine Translation for JP 2655779 B2, retrieved Dec. 31, 2019 from J-PlatPat (Japan Platform for Patent Information). (Year: 2019).*

European Search Report (Application No. 12748875.7—PCT/JP20121054010) (7 pages—dated Jul. 17, 2014).

Japanese Office Action with English Translation (Japanese Patent Application No. 2011-036345) (8 pages—dated Jul. 29, 2014.

Japanese Office Action with English Translation (Japanese Patent Application No. 2015-011606) (7 pages—dated Jan. 22, 2016).

U.S. Office Action with Notice of References Cited (U.S. Appl. No. 14/000,687) (20 pages—dated Nov. 4, 2014).

U.S. Office Action with Notice of References Cited (U.S. Appl. No. 14/000,687) (13 pages—dated May 19, 2015).

U.S. Advisory Action with Notice of References Cited (U.S. Appl. No. 14/000,687) (7 pages—dated Aug. 25, 2015).

U.S. Office Action with Notice of References Cited (U.S. Appl. No. 14/000,687) (13 pages—dated Jan. 15, 2016).

U.S. Office Action with Notice of References Cited (U.S. Appl. No. 14/000,687) (18 pages—dated May 25, 2016).

U.S. Office Action with Notice of References Cited (U.S. Appl. No. 14/000,687) (14 pages—dated Sep. 16, 2016).

U.S. Office Action with Notice of References Cited (U.S. Appl. No. 14/000,687) (17 pages—dated May 3, 2017).

* cited by examiner

BANKNOTE HANDLING APPARATUS

CROSS-REFERENCE TO RELATED APPLICATIONS

This application is a continuation of U.S. patent application Ser. No. 14/000,687 filed on Nov. 22, 2013, incorporated herein by reference, which was based upon and claimed the benefit of priority from the prior PCT/JP2012/054010 filed on Feb. 20, 2012; Japanese Patent Application No. JP2011-036338, filed on Feb. 22, 2011 and Japanese Patent Application No. JP2011-036345 filed on Feb. 22, 2011, the entire contents of which are incorporated herein by reference.

TECHNICAL FIELD

The present invention relates to a banknote handling apparatus. For example, the present invention pertains to a banknote handling apparatus configured to replenish a cash settlement apparatus installed in a checkout counter of a store with banknotes, and configured to collect banknotes from the cash settlement apparatus.

BACKGROUND ART

In order that cash (a' banknote, a coin) is handed over between a clerk and a customer in a checkout counter of a store, a cash settlement apparatus has been conventionally used. The cash settlement apparatus has a function for counting cash having been put thereinto, for storing the cash, and for dispensing cash stored therein as change. Generally, the checkout counter is composed of a banknote settlement apparatus (banknote change machine), a coin settlement apparatus (coin change machine) and a money register such as a POS (Point Of Sales) register, which are communicably connected to each other.

On the other hand, in a back office of the store, in order that cash such as a change fund is loaded (replenished) to the cash settlement apparatus installed in the store, or that sales proceeds in the cash settlement apparatus are collected, a cash accounting apparatus is used. The cash accounting apparatus has a function for storing (depositing) cash having been collected from the cash settlement apparatus, and for dispensing cash to be loaded to the cash settlement apparatus. The cash accounting apparatus includes a banknote accounting apparatus and a coin accounting apparatus.

In recent years, there has been proposed to use a cassette for transporting cash (hereinafter referred to as "cash transport cassette") in order to ensure security when cash is transported between a cash settlement apparatus and a cash accounting apparatus.

Citation 1 discloses a system for transporting banknotes between a cash station (10) including a cash safe (12) and a teller safe (26) including a docking station (28), with the use of a banknote container (14) capable of containing banknotes. In addition, Citation 2 discloses a replenishing and collecting cassette (8) configured to collect and store banknotes.

Patent Document 1: EP2031567B

Patent Document 2: JP2007-034522A

SUMMARY OF THE INVENTION

Actually, there is case in which a banknote settlement apparatus cannot deal with a depositing/dispensing process by a cash transport cassette for containing banknotes (hereinafter referred to as "banknote cassette"), and a clerk manually deposits and dispenses banknotes. In order to cope with this case, a banknote accounting apparatus is preferably capable of not only dealing with a depositing/dispensing process by the banknote cassette, but also dealing with the conventional manual depositing/dispensing process.

In addition, conventionally, a banknote accounting apparatus is configured to recognize a denomination, an authenticity, a suspiciousness in authenticity, a fitness, an version and so on of a deposited banknote, and configured to dispense an unrecognizable banknote as a reject banknote to the outside of the apparatus. However, when a banknote is deposited to the banknote accounting apparatus by using the banknote cassette, it is not preferable to dispense a reject banknote having been deposited from the banknote cassette to the outside of the banknote accounting apparatus, because of inconsistency in terms of security securement.

Thus, the object of the present invention is to enable a depositing process without dispensing a reject banknote, which has been deposited from a banknote cassette, to the outside, in a banknote accounting apparatus (banknote handling apparatus) capable of dealing with both a depositing/dispensing process by the transport cassette and a manual depositing/dispensing process.

A banknote handling apparatus in one embodiment of the present invention is a banknote handling apparatus configured to receive a banknote from at least two kinds of banknote feeding units, the banknote handling apparatus comprising: a transport unit configured such that the banknote feeding unit is connected thereto, the transport unit configured to transport a received banknote; a recognition unit configured to recognize the banknote being transported; an apparatus-internal reject unit configured to store a reject banknote inside the banknote handling apparatus; an apparatus-external reject unit configured to dispense a reject banknote outside the banknote handling apparatus; a unit deciding part configured to decide the banknote feeding unit for feeding a banknote; and a control unit configured to decide, when the recognition unit recognizes a banknote having been received from the banknote feeding unit as a reject banknote, to which one of the apparatus-internal reject unit and the apparatus-external reject unit the reject banknote is transported, based on the banknote feeding unit having fed the banknote.

In the banknote handling apparatus in the one embodiment of the present invention, it is preferable that the unit deciding part is configured to decide the banknote feeding unit for feeding a banknote, based on a connection condition of the banknote feeding unit to the transport unit.

The banknote handling apparatus in the one embodiment of the present invention preferably further includes a process reception unit configured to receive an instruction for process, wherein the unit deciding part is configured to decide the banknote feeding unit for feeding a banknote, based on process contents having been received by the process reception unit.

In the banknote handling apparatus in the one embodiment of the present invention, it is preferable that the banknote feeding units are: a banknote receiving unit configured to receive a banknote(s) from outside and configured to feed the banknotes one by one; and a banknote cassette configured to store a banknote therein and configured to feed the banknote stored therein.

In the banknote handling apparatus in the one embodiment of the present invention, it is preferable that the control unit is configured to perform a control process such that a reject banknote having been received from the banknote receiving unit is transported to the apparatus-external reject unit, and that a reject banknote having been received from the banknote cassette is transported to the apparatus-internal reject unit.

The banknote handling apparatus in the one embodiment of the present invention preferably further includes a process reception unit configured to receive an instruction for process, wherein the control unit is configured to perform a control process such that a reject banknote having been received from the banknote cassette is transported to the apparatus-external reject unit, based on an instruction having been received by the process reception unit.

In the banknote handling apparatus in the one embodiment of the present invention, it is preferable that the control unit is configured to perform a control process such that a predetermined reject banknote having been received from the banknote cassette is transported to the apparatus-external reject unit, based on information in a memory unit of the banknote cassette, related to a stored banknote.

The banknote handling apparatus in the one embodiment of the present invention preferably further includes a storing unit configured to store a banknote, wherein the control unit is configured to perform a control process, when a banknote having been fed out from the storing unit is recognized as a reject banknote by the recognition unit, such that the reject banknote is transported to the apparatus-internal reject unit.

A banknote handling apparatus in one embodiment of the present invention is a banknote handling apparatus including a transport unit configured to receive a banknote from an end portion thereof and configured to transport the banknote into the banknote handling apparatus; and a banknote-feeding-unit connecting unit on which at least two kinds of banknote feeding units can be attached thereon, the banknote-feeding-unit connecting unit configured to connect the banknote feeding unit and the transport unit to each other such that a banknote having been fed out from the banknote feeding unit is transported from the end portion of the transport unit.

In the banknote handling apparatus in the one embodiment of the present invention, it is preferable that the banknote feeding units are a banknote receiving unit configured to receive a banknote(s) from outside and configured to feed the banknotes one by one; and a banknote cassette configured to store a banknote therein and configured to feed the banknote stored therein.

In the banknote handling apparatus in the one embodiment of the present invention, it is preferable that the banknote receiving unit is integrally formed with the banknote handling apparatus; the banknote receiving unit is configured to be movable between a first position at which the banknote receiving unit is connected to the transport unit and a second position at which the banknote receiving unit is disconnected from the transport unit; and when the banknote receiving unit is placed on the second position, the banknote cassette is attachable to the first position.

In the banknote handling apparatus in the one embodiment of the present invention, it is preferable that the banknote receiving unit can be attached to and detached form the banknote handling apparatus.

According to the banknote handling apparatus of the present invention, a banknote, which has been deposited from the banknote feeding unit with its security being ensured, can be transported to the apparatus-internal reject unit to be stored therein. Thus, a banknote security can be maintained.

BRIEF DESCRIPTION OF THE DRAWINGS

Each of FIG. 4A and FIG. 4B is sectional view showing an example of an inside structure of the banknote accounting apparatus 22, in which FIG. 4B shows a condition in which a banknote cassette 30*a* is attached to the depositing unit 210*a*.

Each of FIG. 5A and FIG. 5B is a view for explaining a depositing process of the banknote accounting apparatus 22, in which FIG. 5B shows a banknote transport route when the banknote cassette 30*a* is attached.

FIG. 6 is a view for explaining a dispensing process of banknote accounting apparatus 22, in which

Each of FIG. 9A

Each of FIG. 10A

Each of FIG. 11A

MODE FOR CARRYING OUT THE INVENTION

Figure 1:
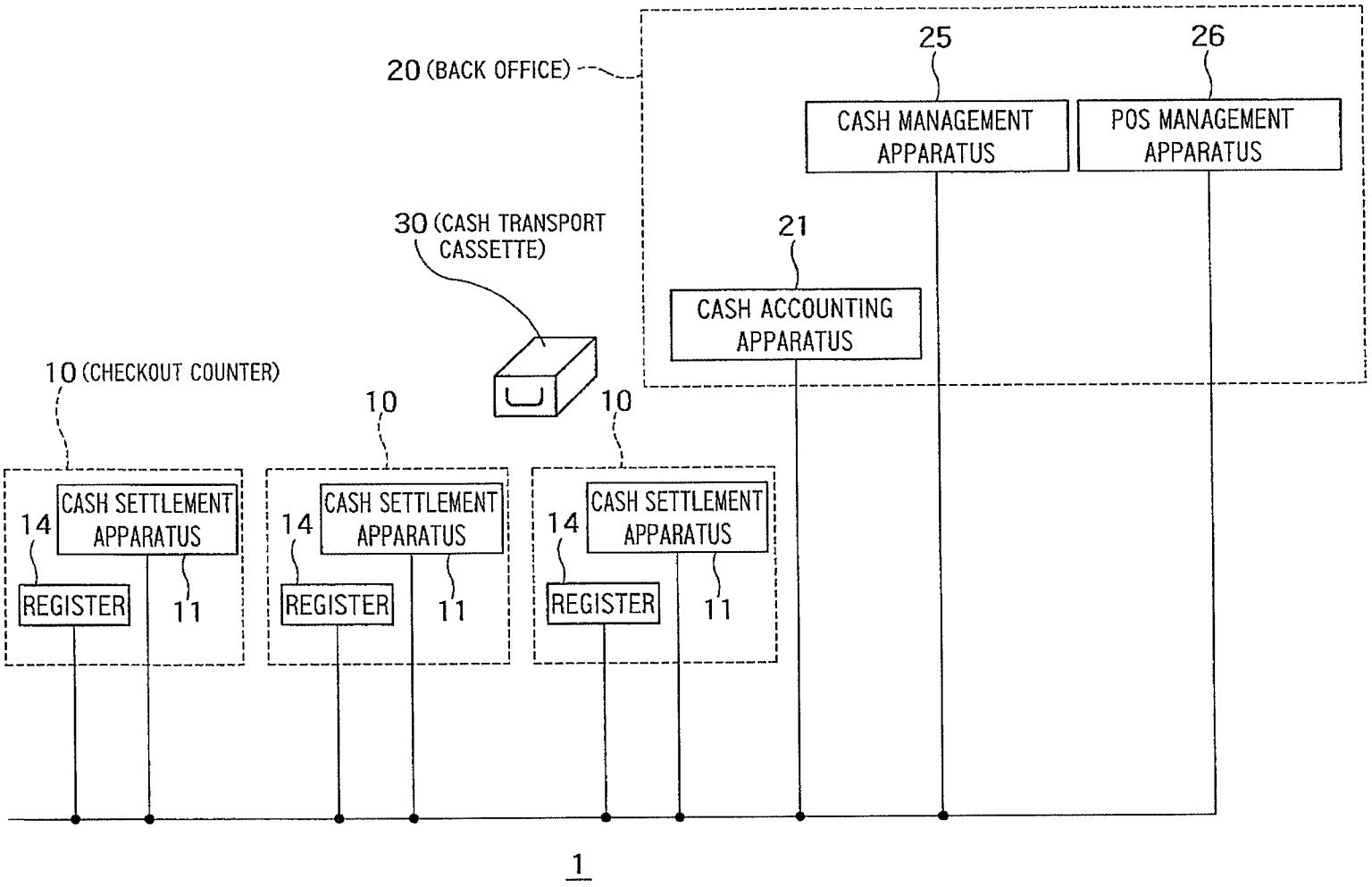
FIG. 1 is a block view showing a structural example of a cash management system 1 in accordance with an embodiment of the present invention.

A cash management system 1 shown in FIG. 1 is described as an example of a system in which a banknote accounting apparatus in this embodiment is used.

FIG. 1 is a block view showing a structural example of the cash management system 1. The cash management system 1 is a system configured to handle and manage cash having been received by a clerk from a customer and cash to be paid from the clerk to the customer.

The cash management system 1 is composed of a checkout counter 1 installed in a checkout area in a store and configured to deposit and dispense cash handed over between a clerk and a customer, a back office 20 configured to manage cash in the checkout counter 10 and products, and a cash transport cassette 30 configured to transport cash between the checkout counter 10 and the back office 20.

The checkout counter 10 includes a cash settlement apparatus 11 configured to deposit and dispense cash so as to perform a settlement process with respect to a customer, and a register 14. The register 14 is, for example, a POS register to be operated by a clerk or a self checkout register to be operated by a customer. In FIG. 1, the checkout area includes the three checkout counters 10.

The cash settlement apparatus 11 is operated by a clerk through the register 14, and is used in a settlement process between a clerk and a customer. For example, the cash settlement apparatus 11 deposits expense paid by a customer or dispenses change to be paid to the customer. The cash settlement apparatus 11 is communicably connected to the register 14 and is configured to perform a settlement process in cooperation with the register 14 corresponding thereto. The cash settlement apparatus 11 may be integrally formed with the register 14.

The back office 20 includes a cash accounting apparatus 21, a cash management apparatus 25 and a POS management apparatus 26. The cash accounting apparatus 21 is communicably connected to the cash settlement apparatuses 11, and is configured to dispense a change fund to be loaded to the cash settlement apparatuses 11, or configured to deposit sales proceeds having been collected from the cash settlement apparatuses 11. The cash management apparatus 25 is communicably connected to the cash settlement apparatuses 11 and the cash accounting apparatus 21 through a LAN (Local Area Network) or the like. The cash management apparatus 25 is configured to manage cash stored in the cash settlement apparatuses 11 and the cash accounting apparatus 21. For example, the cash management apparatus 25 is configured to manage cash having been settled in the respective cash settlement apparatuses 11, and cash passed between each cash settlement apparatus 11 and the cash accounting apparatus 21. In addition, the cash management apparatus 25 may monitor whether the cash transport cassette 30 is attached or not on the cash settlement apparatus 11 or the cash accounting apparatus 21. The POS management apparatus 26 is configured to manage a flow of commercial products. Since the flow of commercial products is not directly related to the present invention, detailed description of the POS management apparatus 26 is omitted.

The cash transport cassette 30 can be attached to and detached from the cash settlement apparatus 11 and the cash accounting apparatus 21. When the cash transport cassette 30 is attached to the cash settlement apparatus 11 or the cash accounting apparatus 21, the cash transport cassette 30 can pass cash between the cash transport cassette 30 and the cash settlement apparatus 11, or pass cash between the cash transport cassette 30 and the cash accounting apparatus 21. On the other hand, when the cash transport cassette 30 is detached from the cash settlement apparatus 11 and the cash accounting apparatus 21, the cash transport cassette 30 is configured to store cash therein such that the cash cannot be taken out therefrom.

A clerk transports cash between the cash settlement apparatus 11 and the cash accounting apparatus 21, by using the cash transport cassette 30. For example, when a change fund is loaded, a clerk transports cash having been dispensed from the cash accounting apparatus 21 to be loaded to the cash settlement apparatus 11, from the cash accounting apparatus 21 to the cash settlement apparatus 11, by using the cash transport cassette 30. In addition, when sales proceeds are collected, a clerk transports cash having been collected from the cash settlement apparatus 11 to be deposited to the cash accounting apparatus 21, from the cash settlement apparatus 11 to the cash accounting apparatus 21, by using the cash transport cassette 30. Since the clerk cannot touch the cash in the cash transport cassette 30 during cash transporting, the cash can be transported safely in terms of security.

The cash transport cassette 30 may be configured to be capable of storing and feeding any one of a banknote and a coin, or may be configured to be capable of storing and feeding both a banknote and a coin.

The cash transport cassette 30 for banknote (banknote cassette 30*a*) may be a cassette of a stacking type in which banknotes are stacked on one another, or may be a cassette of a tape reeling type in which banknotes, which are sandwiched, one by one, by one tape or a plurality of tapes, are reeled up together with the tapes. The cash transport cassette 30 for coin may be a cassette configured to store coins in a denomination mixed state.

The cash transport cassette 30 includes a memory unit configured to store identification information (cassette ID) for specifying the cash transport cassette 30 and information related to stored cash (an amount for each denomination and so on). When the cash transport cassette 30 is of a tape reeling type, the memory unit is configured to store a storing order of cash stored in the cash transport cassette 30, and information relating to a denomination, an authenticity and so on of each cash.

Figure 2:
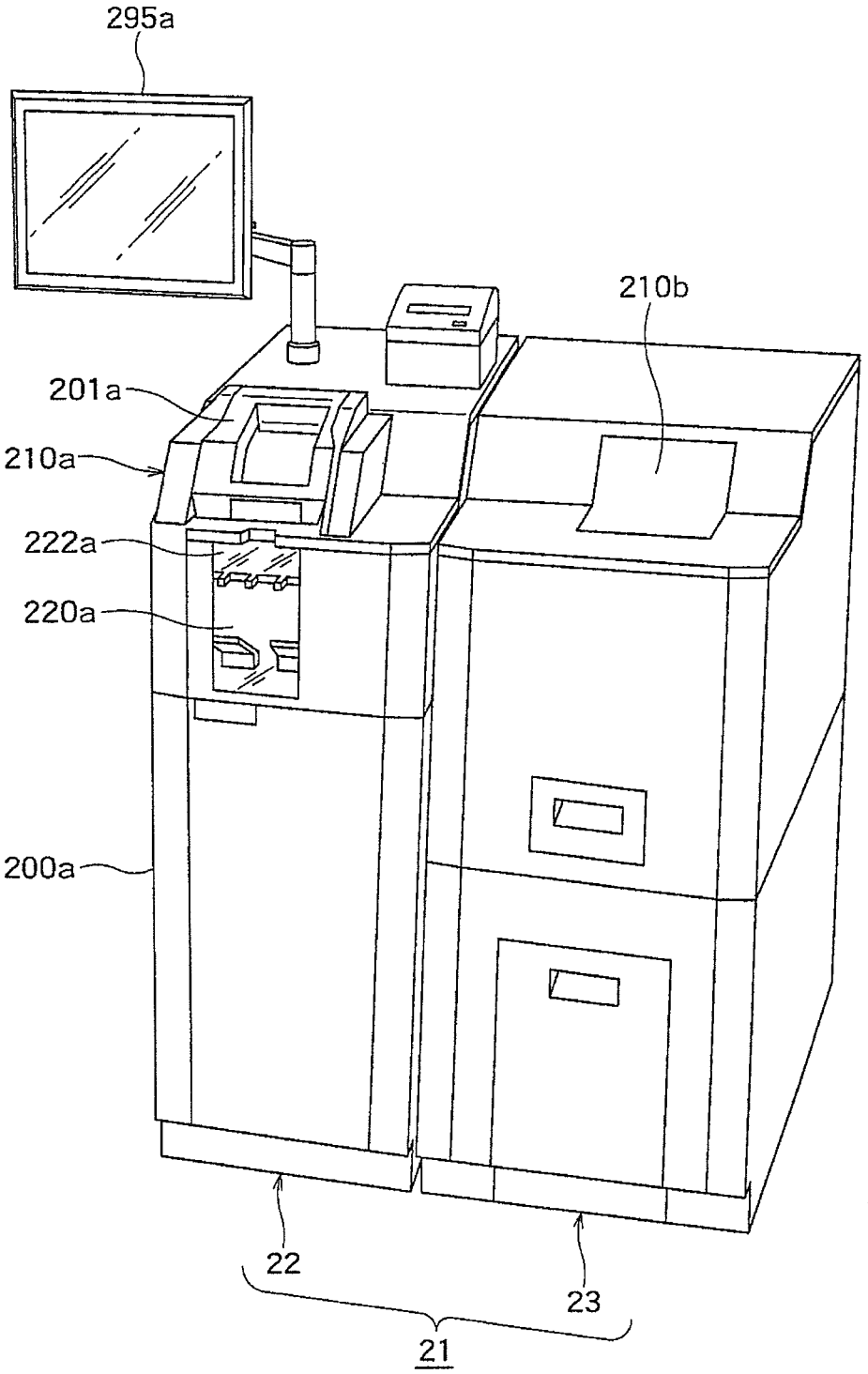
FIG. 2 is a view showing an example of an appearance of a cash accounting apparatus 21.

FIG. 2 is a view showing an example of an appearance of the cash accounting apparatus 21. The cash accounting apparatus 21 includes a banknote accounting apparatus 22 and a coin accounting apparatus 23. The banknote accounting apparatus 22 is configured to dispense a banknote to be loaded to the banknote settlement apparatus 12, and configured to deposit a banknote having been collected from the banknote settlement apparatus 12. The coin accounting apparatus 23 is configured to dispense a coin to be loaded to the coin settlement apparatus 13, and configured to deposit a coin having been collected from the coin settlement apparatus 13.

Next, a structure of the banknote accounting apparatus 22 as a banknote handling apparatus is described. The banknote accounting apparatus 22 includes a housing 200*a*, a depositing unit 210*a*, a dispensing unit 220*a* and an operation display unit 295*a*. As will be described in detail below, the banknote accounting apparatus 22 is configured to be capable of receiving a banknote from a banknote feeding unit. The banknote feeding unit is a unit capable of feeding a banknote(s). The banknote feeding unit includes a banknote receiving unit 201*a* configured to receive a banknote(s) from an outside of the banknote accounting apparatus 22 and configured to feed the banknotes one by one, and a banknote cassette 30*a* configured to store a banknote(s) therein and configured to feed the banknote(s) stored therein.

Figure 4B:
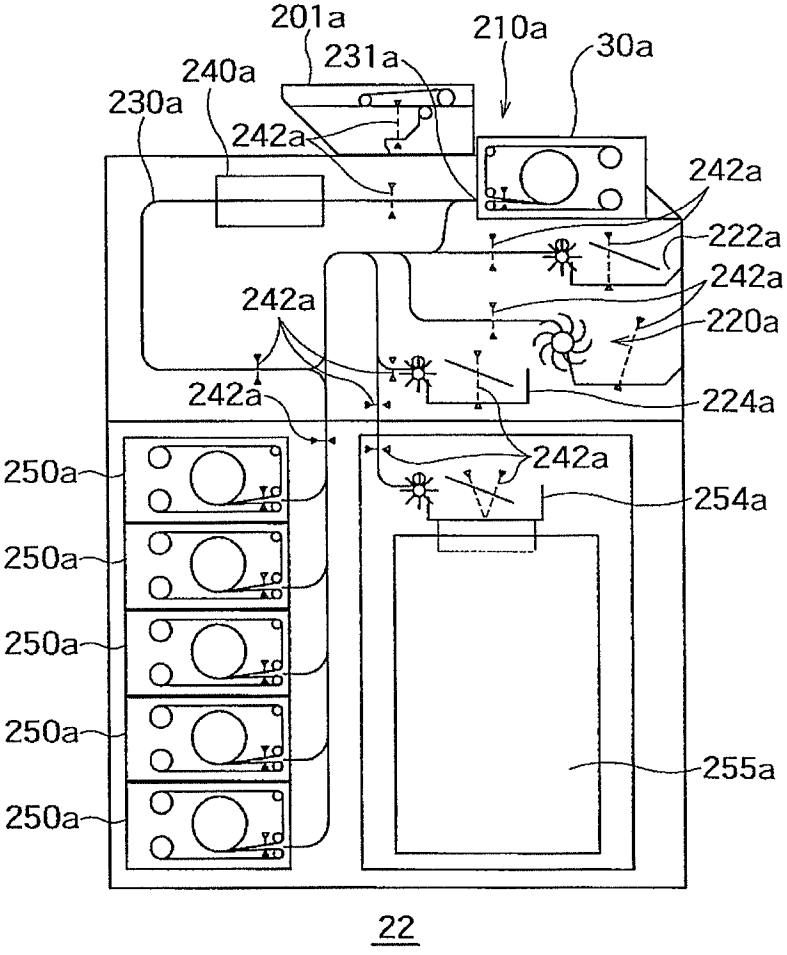
Figure 4A:
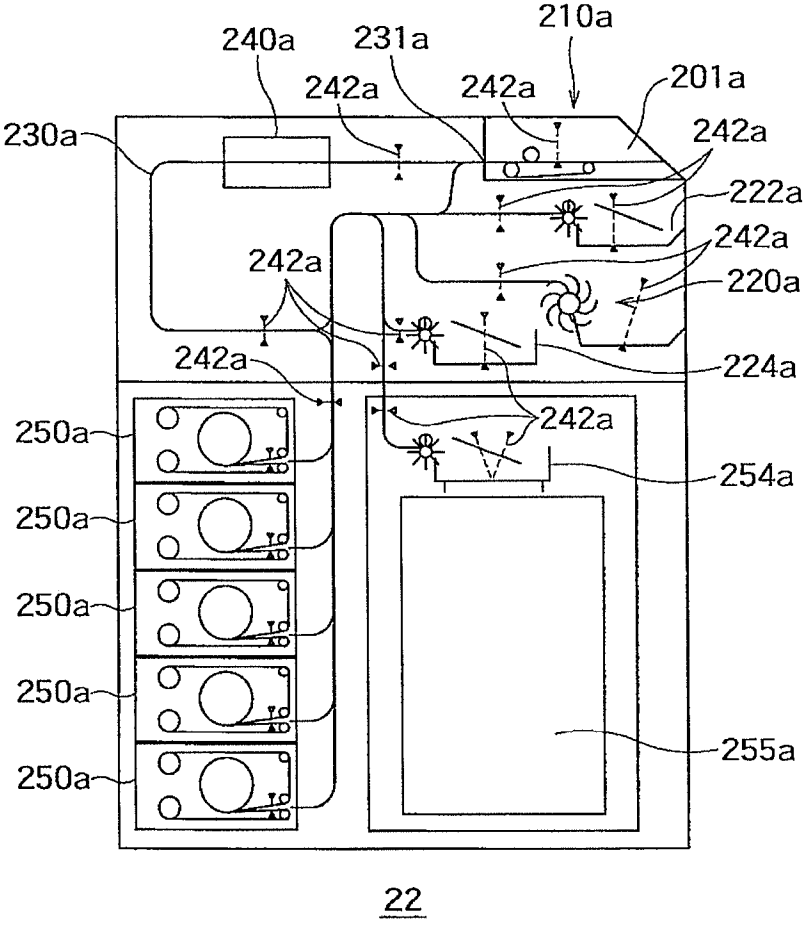
FIG. 4A shows a condition where a banknote receiving unit 201*a* is attached to a depositing unit 210*a*.

As shown in FIGS. 4A and 4B, the depositing unit 210*a* is disposed on an end portion 231*a* of a transport unit 230*a*, and is configured such that the banknote feeding unit can be attached (deposited) thereon. When the banknote feeding unit is attached to the depositing unit 210*a*, a banknote having been fed out from the banknote feeding unit can be transported into the banknote accounting apparatus 22 through the end portion 231*a* of the transport unit 230*a*. Namely, the depositing unit 210*a* connects the banknote feeding unit and the transport unit 230*a* to each other, such that a banknote having been fed out from the banknote feeding unit can be transported into the apparatus from the end portion 231*a* of the transport unit 230*a*. Thus, the depositing unit 210*a* may be referred to as banknote-feeding-unit connecting unit. For example, when a clerk manually deposits a banknote to the banknote accounting apparatus 22, the banknote receiving unit 201*a* is attached to the depositing unit 210*a*. On the other hand, when a clerk deposits a banknote to the banknote accounting apparatus 22 by using the banknote cassette 30*a* (hereinafter referred to also as "cassette depositing"), the banknote cassette 30*a*, in place of the banknote receiving unit 201*a*, is attached to the depositing unit 210*a* (see FIG. 4B). Namely, the banknote accounting apparatus 22 is configured such that the banknote cassette 30*a*, in place of the banknote receiving unit 201*a*, can be attached to and detached from the depositing unit 210*a*.

Not limited to the banknote receiving unit 201*a* and the banknote cassette 30*a*, the depositing unit 210*a* may be configured such that a banknote feeding unit of another structure can be connected thereto.

The dispensing unit 220*a* is provided for dispensing a banknote to an outside of the banknote accounting apparatus 22.

The operation display unit 295*a* is configured to display conditions of the cash management apparatus 21, the cash settlement apparatus 11 and the cash transport cassette 30, and configured such that an operator such as a clerk can input instructions and data therethrough. The operation display unit 295*a* may be a display of a touch panel type. The operation display unit 295*a* is disposed on any one of the banknote accounting apparatus 22 and the coin accounting apparatus 23, and is commonly used to display information of both. In addition, as means for operating the cash settlement apparatus 21, a card reader (not shown) may be disposed on the banknote accounting apparatus 22.

Figure 3:
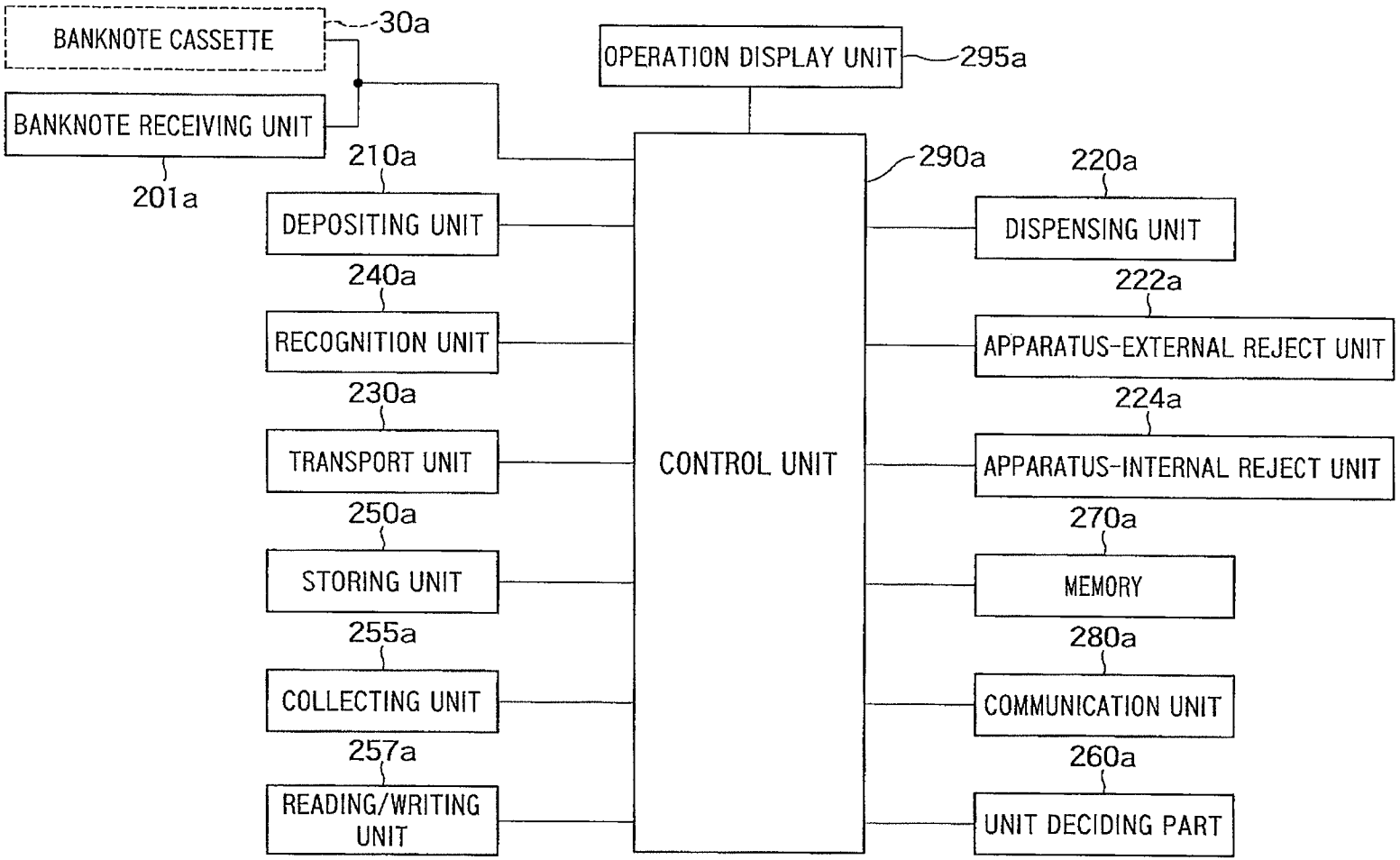
FIG. 3 is a block view showing a structural example of a banknote accounting apparatus 22.

FIG. 3 is a block view showing a structural example of the banknote accounting apparatus 22. In addition to the aforementioned depositing unit 210*a*, the dispensing unit 220*a* and the operation display unit 295*a*, the banknote accounting apparatus 22 further includes the transport unit 230*a*, a recognition unit 240*a*, a storing unit 250*a*, a collecting unit 255*a*, a reading/writing unit 257*a*, a unit deciding part 260*a*, an apparatus-external reject unit 222*a*, an apparatus-internal reject unit 224*a*, a memory 270*a*, a communication unit 280*a* and a control unit 290*a*.

The transport unit 230*a* is configured such that the banknote feeding unit is connected thereto, and configured to transport a banknote having been received into the apparatus. In more detail, the transport unit 230*a* is configured to transport, to the storing unit 250*a*, a banknote having been put into the banknote receiving unit 201*a* attached to the depositing unit 210*a*, or configured to transport, from the storing unit 250*a*, a banknote to be dispensed from the dispensing unit 220*a*. In addition, the transport unit 230*a* is configured to transport a banknote from the storing unit 250*a* to the banknote cassette 30*a*, or configured to transport a banknote from the banknote cassette 30*a* to the storing unit 250*a*. As shown in FIGS. 4A and 4B, sensors 242*a* such as photosensors are disposed on the transport unit 230*a* and predetermined locations. The sensors 242*a* are configured to detect presence, of a banknote and passage of a banknote.

The recognition unit 240*a* includes a sensor such as a magnetic sensor, a fluorescent sensor, a metal thread sensor, a thickness sensor or an image sensor, and is configured to recognize whether a banknote being transported by the transport unit 230*a* is an acceptable banknote or a reject banknote that is unacceptable, by comparing a feature of each banknote stored therein and a sensor output with each other. The reject banknote is, for example, a paper sheet other than a banknote, a foreign banknote not to be handled, and a banknote that cannot be recognized because it is torn or stained. In addition, banknotes which are transported in an overlapped state, and banknotes which are transported with an interval therebetween being smaller than a predetermined interval, are also handled as reject banknotes.

Further, the recognition unit 240*a* is configured to recognize a denomination, an authenticity, a fitness (fit note/unfit note), an version and so on of a banknote that is not a reject banknote. The fit note and the unfit note are banknotes whose denomination can be recognized, but the fit note is a banknote suited for circulation and the unfit note is a banknote unsuited for circulation because it is torn or stained.

The storing unit 250*a* is configured to store, by denomination, banknotes having been recognized by the recognition unit 240*a*, and configured to feed, one by one, banknotes stored therein. The storing unit 250*a* may be a storing unit of a stacking type or a storing unit of a tape reeling type. The collecting unit 255*a* is used when a banknotes stored in the storing unit 250*a* is collected. The collecting unit 255*a* is made of a box or a pouch.

The reading/writing unit 257*a* is wiredly or wirelessly connected communicably to the memory unit disposed on the banknote cassette 30*a*, and is configured to read out information stored in the memory unit or configured to write information to the memory unit. The memory unit of the banknote cassette 30*a* stores at least cassette ID information for specifying the banknote cassette 30*a*, and may store information related to a banknote stored in the banknote cassette 30*a*, such as a denomination and an amount of the banknote, according to need. In addition, the communication unit 280*a* in place of the reading/writing unit 257*a* may receive information (e.g., a denomination and an amount of a stored banknote) other than cassette ID from the banknote settlement apparatus 12 that has stored a banknote to the banknote cassette 30*a*, through a communication line such as LAN.

The unit deciding part 260*a* is configured to decide the banknote feeding unit for feeding a banknote. More specifically, the unit deciding part 260*a* is configured to decide the banknote feeding unit for feeding a banknote, based on a connection condition of the banknote feeding unit to the transport unit 230*a*. The unit deciding part 260*a* recognizes a connection condition of the banknote feeding unit to the transport unit 230*a*, by means of information from a set detection sensor and a unit connector, and decides the banknote feeding unit for feeding a banknote. The set detection sensor is a sensor configured to detect that the banknote receiving unit 201*a* has been attached to the depositing unit 210*a*. The set detection sensor is formed of, e.g., a photo interrupter. When a light shielding plate disposed on the banknote receiving unit 201*a* shields light, the photo interrupter detects that the banknote receiving unit 201*a* has been attached to the depositing unit 210*a*. The unit connector is connected to terminals (connectors) of the banknote receiving unit 201*a* and the banknote cassette 30 so that the banknote receiving unit 201*a* and the banknote cassette 30*a* are connected to a driving power source line and a signal line.

The unit deciding part 260*a* is configured to detect whether the banknote feeding unit is attached to the depositing unit 210*a* or not, from a conducting condition of the unit connector, and configured to detect a kind of the banknote feeding unit attached to the depositing unit 210*a*, by means of the set detection sensor.

The banknote accounting apparatus 22 can access (read and write) the memory unit in the banknote cassette 30*a* through the unit connector. In this case, the unit deciding part 260*a* can recognize a kind of the banknote feeding unit based on recognition information stored in the memory unit. In addition, the banknote receiving unit 201*a* may have a memory unit configured to store recognition information and so on. In this case, the unit deciding part 260*a* can recognize a kind of the banknote feeding unit, based on the recognition information stored in the memory unit of the banknote receiving unit 201*a*.

When the set detection sensor and the unit connector are used, the unit deciding part 260*a* is configured to detect attachment of the banknote feeding unit by the unit connector. When the unit deciding part 260*a* detects attachment of the banknote receiving unit 201*a* by means of the set detection sensor, the unit deciding part 260*a* is configured to detect that a banknote is fed out from the banknote receiving unit 201*a*. On the other hand, when the unit deciding part 260*a* detects attachment of the banknote feeding unit by means of the unit connector and does not detect attachment of the banknote receiving unit 201*a* by means of the set detection sensor, the unit deciding part 260*a* is configured to decide that a banknote is fed out from the banknote cassette 30*a*.

The unit deciding part 260*a* may decide the banknote feeding unit for feeding a banknote, based on process contents having been received by the operation display unit 295*a* and the cash management apparatus 25 and so on (hereinafter referred to as "process reception unit"). Thus, for example, when both the banknote receiving unit 201*a* and the banknote cassette 30*a* can be simultaneously attached to a banknote handling apparatus 22X which will be described below, a user can instruct from which a banknote is to be fed out, through the process reception unit.

The apparatus-external reject unit 222*a* and the apparatus-internal reject unit 224*a* are both provided for stacking reject banknotes. The apparatus-external reject unit 222*a* is configured to store a banknote, which has been recognized as a reject banknote by the recognition unit 240*a*, such that the banknote can be take out from the outside of the banknote accounting apparatus 22. On the other hand, the apparatus-internal reject unit 224*a* is configured to store a banknote, which has been recognized as a reject banknote by the recognition unit 240*a*, such that the banknote is securely stored in the banknote accounting apparatus 22. The apparatus-internal reject unit 224*a* is disposed inside the housing 200*a*, and configured to store a banknote in the apparatus. Thus, a user who does not have a management authority, such as a clerk, cannot take out the banknote in the apparatus-internal reject unit 224*a*.

The memory 270*a* includes various programs for controlling the cash accounting apparatus 22, a ORM or a HDD storing data, and a RAM serving as a program loading area or a working area when a program is executed, and so on. Further, the memory 270*a* is configured to store information (a denomination, an amount and so on) of a banknote stored in the storing unit 250*a* and the collecting unit 255*a*. Furthermore, the memory 270*a* is configured to store contents of a process having performed by the banknote accounting apparatus 22 (date and time, a process type, a banknote transport destination, a denomination of a processed banknote, quantities of a fit note(s) and an unfit note(s), an operator's ID, etc.). When the soring unit 250*a* is a storing unit of a tape reeling type, the memory 270*a* is configured to store a storing order of banknotes stored in the storing unit 250*a* and information such as a denomination, a fitness and so on of each of the banknotes.

The communication unit 280*a* is provided for communication with other apparatuses (the cash settlement apparatus 11, the cash management apparatus 25, the POS management apparatus 26 and so on) which constitute the cash handling system 1.

The control unit 290*a* is configured to execute a program in the memory 270*a* to control the banknote accounting apparatus 22 as a whole. When the recognition unit 240*a* recognizes banknote having been received from the banknote feeding unit as a reject banknote, the control unit 290*a* is configured to decide to which one (destination) of the apparatus-internal reject unit 224*a* and the apparatus-external reject unit 222*a* the reject banknote is transported, based on the banknote feeding unit having fed the banknote. For example, the control unit 290*a* is configured to decide that a reject banknote having been received from the banknote receiving unit 201 is transported to the apparatus-external reject unit 222*a*, and configured to decide that a reject not having been received from the banknote cassette 30 is transported to the apparatus-internal reject unit 224*a*. Then, the control unit 290*a* controls the transport unit 230*a* such that the reject banknote is transported to the decided transport destination.

Since banknotes in the banknote cassette 30*a* have been once recognized when the banknotes were stored into the banknote cassette 30*a*, it can be considered that all the banknotes are not reject banknotes. However, actually, depending on properties of recognition unit of each apparatus and differences in level setting, there is a possibility that a banknote, which has been judged as a fit note upon cassette depositing, might be judged as an unfit note or a reject banknote. In addition, when banknotes including a reject banknote are collected, there is a possibility that a reject banknote might be stored into the banknote cassette 30.

Next, an example of an inside structure of the banknote accounting apparatus 22 is described with reference to FIGS. 4A and 4B.

FIG. 4A and FIG. 4B are sectional views each showing an example of an inside structure of the banknote accounting apparatus 22. FIG. 4A shows a condition in which the banknote receiving unit 201*a* is attached to the depositing unit 210*a*, and FIG. 4B shows a condition in which the banknote cassette 30*a* is attached to the depositing unit 201*a*. In FIGS. 4A and 4B, illustration of the operation display unit 295*a* is omitted.

As shown in FIG. 4A, when a banknote is deposited to the banknote accounting apparatus 22 by using the banknote receiving unit 201*a*, a clerk attaches the banknote receiving unit 201*a* to the depositing unit 210*a*. Thus, the unit deciding part 260*a* decides the banknote receiving unit 201*a* as the banknote feeding unit, and a banknote having been put into the banknote receiving unit 201*a* is fed to the transport unit 230*a*.

On the other hand, as shown in FIG. 4B, when a banknote in the banknote cassette 30*a* is deposited to the banknote accounting apparatus 22, a clerk attaches the banknote cassette 30*a* to the depositing unit 210*a*. Thus, the unit deciding part 260*a* decides the banknote cassette 30 as the banknote feeding unit, and a banknote stored in the banknote cassette 30*a* is fed to the transport unit 230*a*.

When a banknote is dispensed from the banknote accounting apparatus 22, the storing unit 250*a* feeds, one by one, a banknote(s) to the transport unit 230*a*. The transport unit 230*a* transports the fed banknote to the dispensing unit 220*a* so as to dispense the banknote.

In this manner, the banknote accounting apparatus 22 can store a banknote having been put into the banknote receiving unit 201*a* into the storing unit 250*a*, and can reversely dispense a banknote stored in the storing unit 250*a* to the dispensing unit 220*a*. Namely, the banknote accounting apparatus 22 is configured to reuse a deposited banknote as a banknote to be dispensed.

When a banknote(s) is loaded to the banknote settlement apparatus 12, the storing unit 250*a* feeds, one by one, banknotes to the transport unit 230*a*, in order that the banknotes are transported to the banknote cassette 30*a*. The transport unit 230*a* dispenses the fed banknotes to the banknote cash transport cassette 30*a*. Thus, the banknote accounting apparatus 22 can dispense, to the banknote cassette 30*a*, the banknotes to be loaded to the banknote settlement apparatus 12. When a banknote(s) is collected from the banknote settlement apparatus 12, the banknote cassette 30*a* feeds, one by one, a banknote(s) stored therein to the transport unit 230*a*. The transport unit 230*a* stores the fed banknote into the storing unit 250*a*.

In this manner, the banknote accounting apparatus 22 is configured to dispense, to the banknote cassette 30*a*, a banknote to be loaded to the banknote settlement apparatus 12, or configured to deposit, from the banknote cassette 30*a*, a banknote having been collected from the banknote settlement apparatus 12.

Next, a depositing/dispensing process of the banknote accounting apparatus 22 is descried in more detail with reference to the drawings. The depositing/dispensing process is roughly classified into a depositing process, a dispensing process, a replenishing process and a collecting process. The respective processes are described with reference to FIGS. 5A to 7B.

(Depositing Process)

A depositing process is a process by which a banknote is deposited to the banknote accounting apparatus 22. For example, the depositing process is performed when a banknote having been collected from the banknote settlement apparatus 12 is deposited to the banknote accounting apparatus 22. A banknote can be deposited, by using either the banknote receiving unit 201*a* or the banknote cassette 30*a*.

Figure 5B:
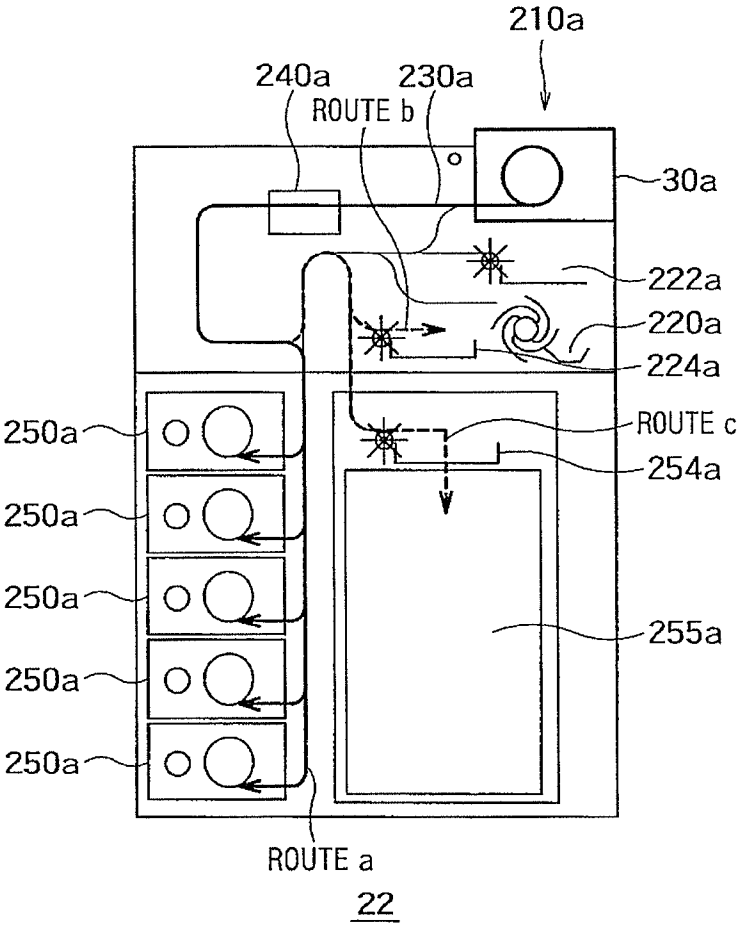
Figure 5A:
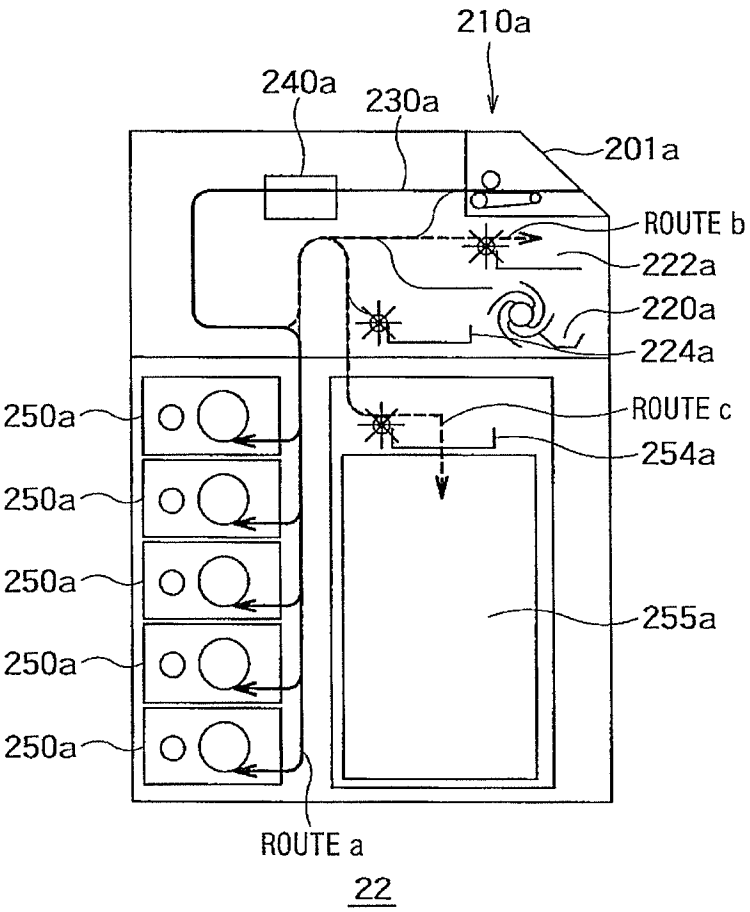
FIG. 5A shows a banknote transport route when the banknote receiving unit 201*a* is attached.

FIG. 5A shows transport routes (a route a, a route b and a route c) of a banknote to be deposited, when the banknote receiving unit 201*a* is attached to the depositing unit 210*a*.

When a clerk has put a banknote(s) to the banknote receiving unit 201*a* and the process reception unit has received a depositing instruction, the banknote receiving unit 201*a* feeds, one by one, the banknotes having been put thereinto, to the transport unit 230*a*. The transport unit 230*a* causes the fed banknotes to pass through the recognition unit 240*a* so as to recognize whether each banknote is a reject banknote or not Based on the recognition result, when a banknote is a normal banknote (that is not a reject banknote), the transport unit 230*a* transports the banknote to the storing unit 250*a* corresponding to a denomination of the banknote (the route a in FIG. 5A). Even when the banknote is a normal banknote but the storing unit 250*a* is full, the transport unit 230*a* transports the banknote to a collecting and stacking unit 254*a* (the route c in FIG. 5A). The collecting and stacking unit 254*a* stacks banknotes having been transported thereto, and opens a bottom surface of the collecting and stacking unit 254*a* so as to let down the stacked banknotes. Thus, the banknotes stacked in the collecting and stacking unit 254*a* are stored into the collecting unit 255*a*. When the number of banknotes stacked in the collecting and stacking unit 254*a* exceeds a full number (the maximum number of stackable banknotes), the transport of a banknote to the collecting and stacking unit 254*a* is stopped. After banknotes stacked therein have been stored into the collecting unit 255*a*, the transport is restarted.

On the other hand, when a banknote has been recognized as a reject banknote by the recognition unit 240*a*, the transport unit 230*a* transports the reject banknote to the apparatus-external reject unit 222*a* (the route b in FIG. 5A).

FIG. 5B shows transport routes (a route a, a route b and a route c) of a banknote to be deposited, when the banknote cassette 30*a* is attached to the depositing unit 210*a*.

When the process reception unit has received a depositing instruction, the cassette 30*a* feeds, one by one, banknotes stored therein, to the transport unit 230*a*. The transport unit 230*a* causes the fed banknotes to pass through the recognition unit 240*a* so as to recognize whether each banknote is a reject banknote or not. Based on the recognition result, when a banknote is a normal banknote, the transport unit 230*a* transports the banknote to the storing unit 250*a* corresponding to a denomination of the banknote (the route a in FIG. 5B). Even when the banknote is a normal banknote but the storing unit 250*a* is full, the transport unit 230*a* transports the banknote to the collecting and stacking unit 254*a* so as to be stored into the collecting unit 255*a* (the route c in FIG. 5B).

On the other hand, when a banknote has been recognized as a reject banknote by the recognition unit 240*a*, the transport unit 230*a* transports the reject banknote to the apparatus-internal reject unit 224*a* (the route b in FIG. 5B).

As described above, the banknote accounting apparatus 22 changes a transport destination of the reject banknote having been received into the apparatus, depending on whether the reject banknote is a banknote having been fed out from the banknote receiving unit 201*a* or a banknote having been fed out from the banknote cassette 30*a*. To be more specific, when the reject banknote is a banknote having been fed out from the banknote receiving unit 201*a*, the control unit 290*a* controls the transport unit 230*a* such that the reject banknote is transported to the apparatus-external reject unit 222*a*. On the other hand, when the reject banknote is a banknote having been fed out from the banknote cassette 30*a*, the control unit 290*a* controls the transport unit 230*a* such that the reject banknote is transported to the apparatus-internal reject unit 224*a*. The contents of the depositing process are stored in the memory 270*a*.

Since a reject banknote in the banknote cassette 30 is transported to be stored into the apparatus-internal reject unit 224*a* disposed inside the housing 200*a*, a user who does not have a management authority, such as a clerk, cannot touch the banknote having been stored in the banknote cassette 30*a*, whereby the security of a banknote in the banknote cassette 30*a* can be maintained. In addition, during the cassette depositing, when the banknote accounting apparatus 22 can recognize a storing order of banknotes in the banknote cassette 30*a* and information of each banknote such as a denomination, a fitness and so on, from the memory unit of the banknote cassette 30*a*, for example, the depositing process can be performed without the banknotes being recognized in the banknote accounting apparatus 22.

(Dispensing Process)

A dispensing process is a process by which a banknote is dispensed from the banknote accounting apparatus 22. For example, the dispensing process is performed when a banknote is replenished to the banknote settlement apparatus 12. A banknote can be dispensed, by using either the banknote receiving unit 201*a* or the banknote cassette 30*a*. FIG. 6A shows a transport route of a banknote to be dispensed when the banknote receiving unit 201 is attached to the depositing unit 210*a* (a route a), and FIG. 6B shows transport routes of a banknote to be dispensed when the banknote cassette 30*a* is attached to the depositing unit 210*a* (the route a and a route b).

When the process reception unit has received a dispensing instruction, the storing unit 250*a* feeds, one by one, banknotes stored therein, to the transport unit 230*a*. The transport unit 230*a* causes the fed banknotes to pass through the sensor 242*a*, and the sensor 242*a* recognizes whether each banknote is a reject banknote or not. Based on the recognition result, when a banknote is a normal banknote, the transport unit 230*a* transports the banknote to the dispensing unit 220*a* if the banknote receiving unit 201*a* is attached, or transports the banknote to the banknote cassette 30*a* if the banknote cassette 30*a* is attached (the route a in FIGS. 6A and 6B).

The banknotes having been transported to the banknote cassette 30*a* are stored into the banknote cassette 30*a*, and the memory unit of the banknote cassette 30*a* stores the number of the stored banknotes for each denomination. When the banknote cassette 30*a* is of a tape reeling type, the memory unit stores a storing order of the banknotes and information of each banknote such as a denomination, a fitness and so on.

Figure 6B:
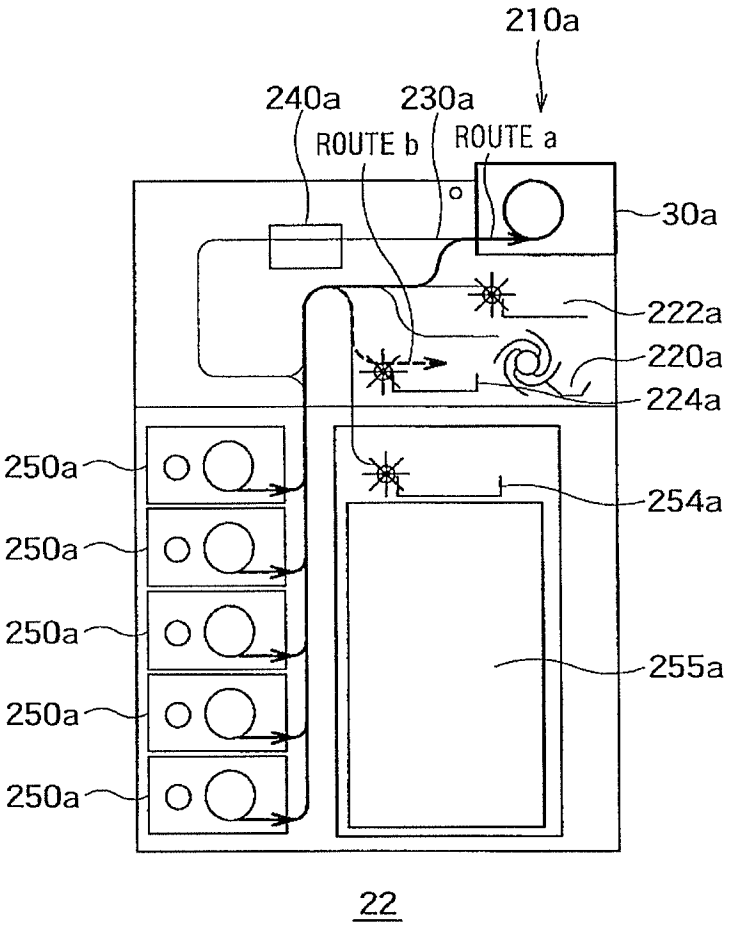
FIG. 6B shows a banknote transport route when the banknote cassette 30*a* is attached.
Figure 6A:
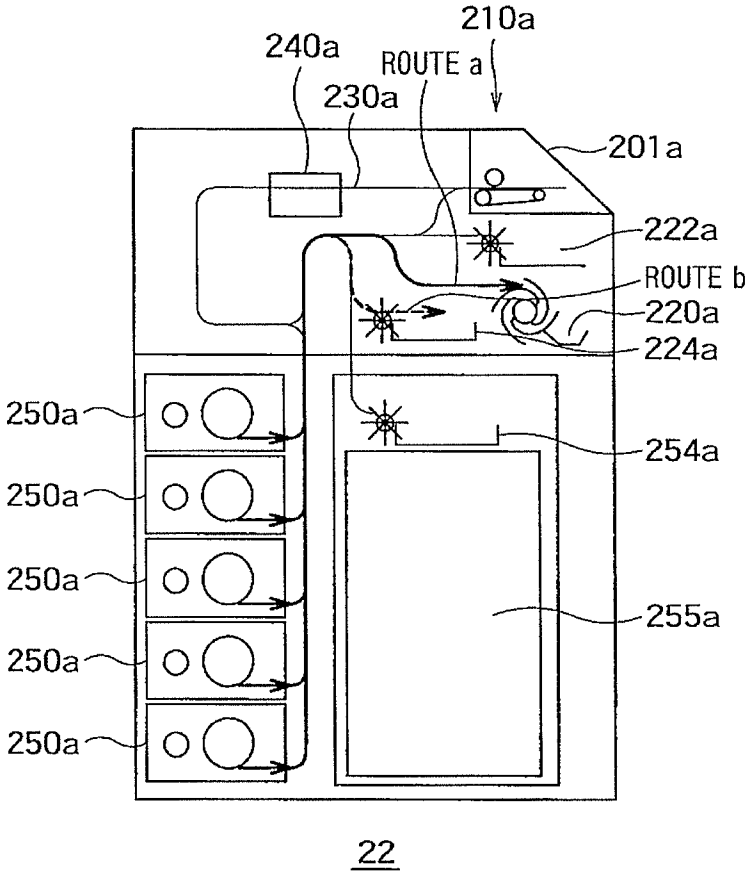
FIG. 6A shows banknote transport route when the banknote receiving unit 201*a* is attached.

On the other hand, when a banknote has been recognized as a reject banknote by the sensor 242*a*, the transport unit 230*a* transports the reject banknote to the apparatus-internal reject unit 224*a*, regardless of the banknote feeding unit attached to the depositing unit 210*a* (the route b in FIGS. 6A and 6B). The contents of the dispensing process are stored in the memory 270*a*.

(Replenishing Process)

A replenishing process is a process by which a banknote is replenished to the banknote accounting apparatus 22. For example, the replenishing process is performed when a banknote in a safe is deposited to the banknote accounting apparatus 22. When the process reception unit has received a replenishing instruction, the replenishing process is performed similarly to the depositing process.

Figure 7B:
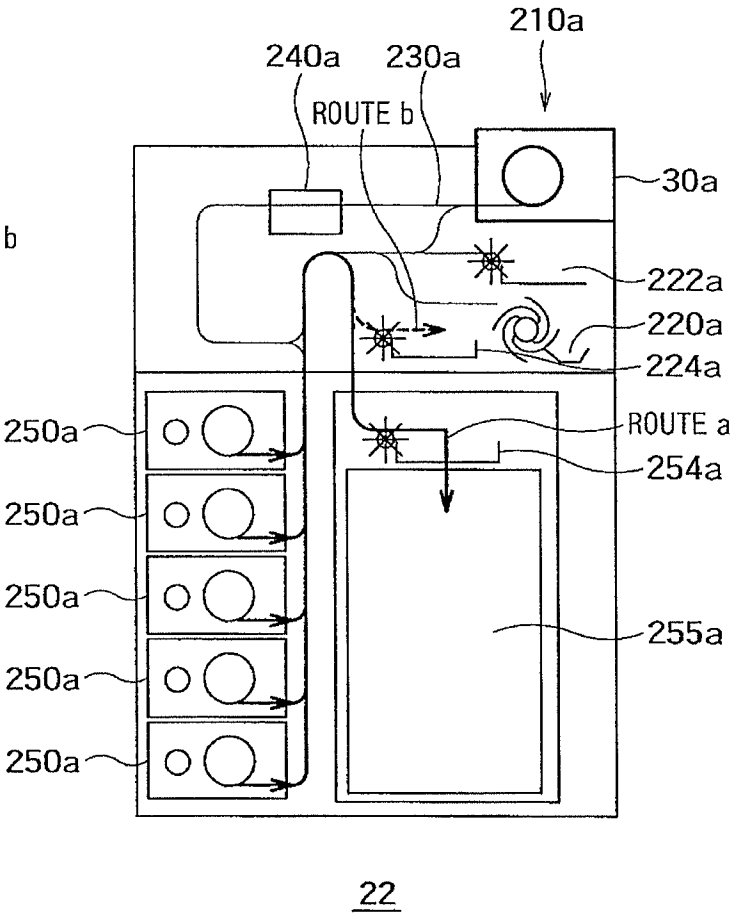
FIG. 7B is a view showing a banknote transport route in a collecting process of the banknote accounting apparatus 22.
Figure 7A:
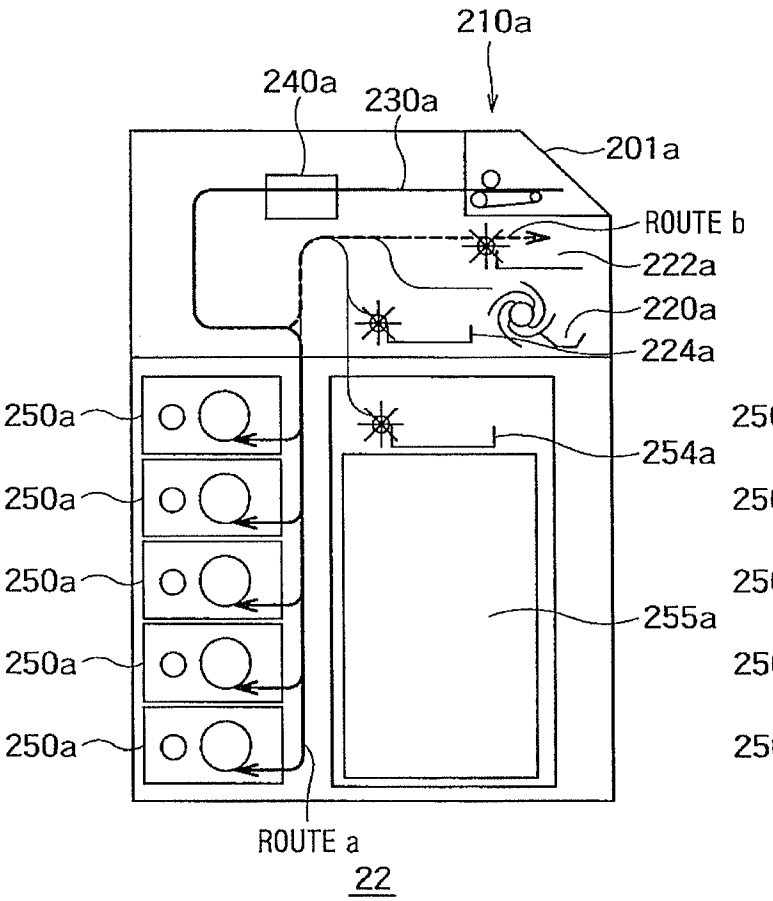
FIG. 7A is a view showing a banknote transport route in a replenishing process of the banknote accounting apparatus 22.

FIG. 7A shows a transport route of a banknote having been replenished from the banknote receiving unit 201*a*. Namely, a route in FIG. 7A shows a transport route of a banknote having been recognized to be normal by the recognition unit 240*a*, and a route b shows a transport route of a banknote having been recognized as a reject banknote by the recognition unit 240*a*. As can be understood from FIG. 7A, the banknote transport routes in the replenishing process are the same as the banknote transport routes in the depositing process (the route a and the route b in FIG. 5A). The contents of the replenishing process are store in the memory 270*a*.

(Collecting Process)

A collecting process is a process by which a banknote in the banknote accounting apparatus 22 is collected. For example, the collecting process is performed when a banknote in the banknote accounting apparatus 22 is dispensed to a safe. FIG. 7B shows a transport route of a banknote having been stored in the storing unit 250*a*, in the collecting process. Namely, a route 1 in FIG. 7B shows a transport route of a banknote having been recognized to be normal by the sensor 242*a*, and a route b shows a transport route of a banknote having been recognized as a reject banknote by the sensor 242*a*.

As shown in FIG. 7B, in the collecting process, when the process reception unit has received a collecting instruction, a normal banknote in the storing unit 250*a* is transported to the collecting unit 255*a*, and a reject banknote is transported to the apparatus-internal reject unit 224*a*. The banknote having been transported to the collecting unit 255*a* is taken out to the outside of the banknote accounting apparatus 22, by a user who has a management authority. When the collecting unit 255*a* becomes full in the course of the collecting process, the collecting unit 255*a* is replaced with another vacant collecting unit 255*a*, whereby the collecting process can be continued. The contents of the collecting process are stored in the memory 270*a*.

In the depositing process and the replenishing process, as to a banknote having been recognized as a banknote of a specific type by the recognition unit 240*a*, even when the banknote has been deposited from the banknote receiving unit 201*a*, the transport unit 230*a* may transport the banknote to the apparatus-internal reject unit 224*a*. For example, in order to prevent circulation of a banknote of category 2 (counterfeit banknote) and a banknote of category 3 (suspicious banknote), which are set up by EC Forum Regulation 1338, paragraph 6, such banknotes are preferably transported to the apparatus-internal reject unit 224*a*, regardless of a type of the banknote feeding unit.

In addition, not limited to an instruction from the process reception unit, change of a transport destination of a reject banknote having been received from the banknote cassette 30*a* may be performed based on the information related to a stored banknote, which is stored in the memory unit of the banknote cassette 30*a*. For example, when information showing that a paper sheet (e.g., a check), which has been fed out $n^{th}$ from the banknote cassette 30*a*, is other than a banknote is stored in the memory unit of the banknote cassette 30*a*, the control unit 290*a* may perform a control process such that the paper sheet, which has been fed out $n^{th}$ from the banknote cassette, is transported to the apparatus-external reject unit 222*a*.

Although one of the banknote receiving unit 201*a* and the banknote cassette 30*a* is attached to the depositing unit 210*a* of the banknote accounting apparatus 22, the present invention is not limited thereto. Namely, the present invention includes a banknote accounting apparatus on which the banknote receiving unit 201*a* and the banknote cassette 30*a* are simultaneously attachable.

Figure 8:
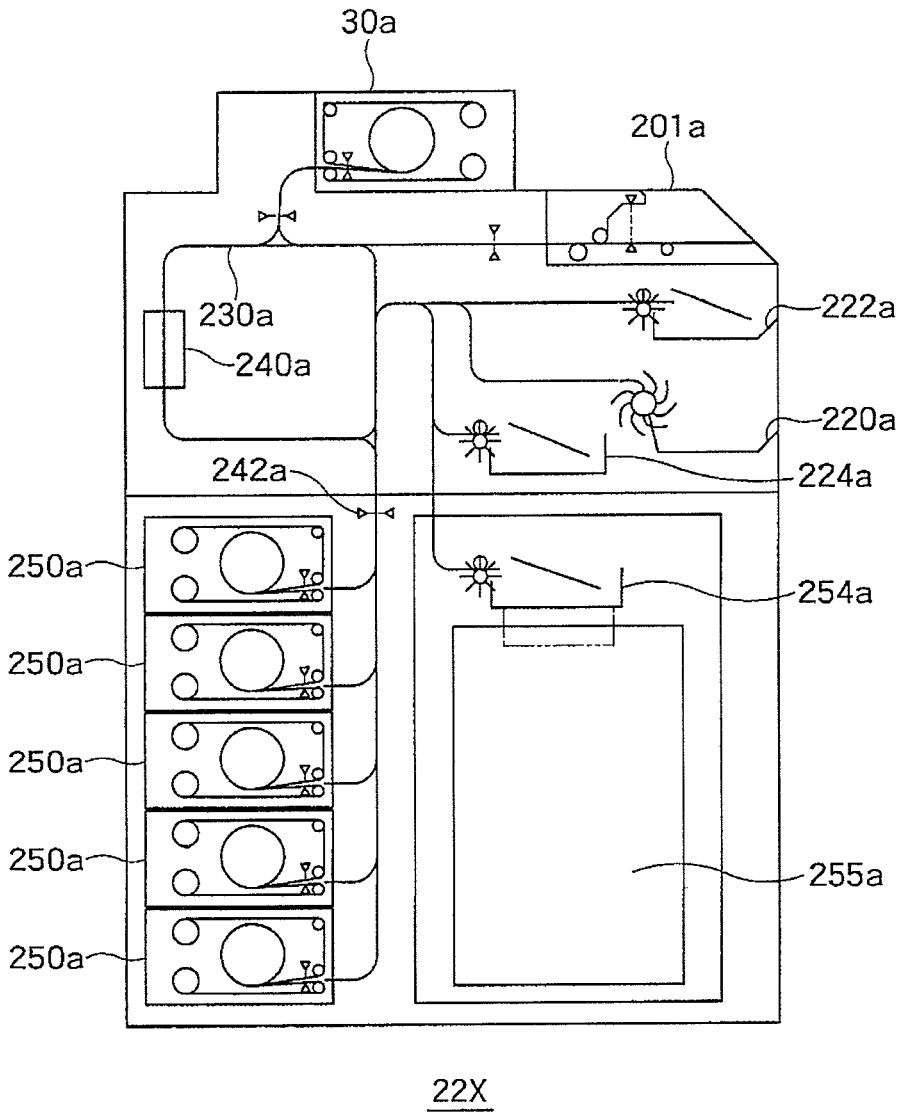
FIG. 8 is a sectional view showing an inside structure of a banknote accounting apparatus 22X.

FIG. 8 is a sectional view showing an inside structure of such a banknote accounting apparatus 22X. Both the banknote receiving unit 201*a* and the banknote cassette 30*a* are attached to the banknote accounting apparatus 22X.

As shown in FIG. 8, the transport unit 230*a* is configured to be capable of transporting a banknote to a predetermined part in the apparatus (the storing unit 250*a*, the apparatus-internal reject unit 224*a*, the apparatus-external reject unit 222*a* and the collecting and stacking unit 254*a*), irrespective of whether the banknote has been received from the banknote receiving unit 201*a* or the banknote cassette 30*a*. In addition, as shown in FIG. 8, the recognition unit 240*a* is disposed on the transport unit 230*a* that is common to a banknote having been fed out from the banknote receiving unit 201*a* and a banknote having been received from the banknote cassette 30*a*.

The control unit 290*a* performs a control process such that a reject banknote having been received from the banknote receiving unit 201*a* is transported to the apparatus-external reject unit 222*a*, and performs a control process such that a reject banknote having been received from the banknote cassette 30*a* is transported to the apparatus-internal reject unit 224*a*.

In the banknote accounting apparatus 22X, a user can optionally select the banknote feeding unit, by giving an instruction to the process reception unit. Based on the process contents having been received by the process reception unit, the unit deciding part 260*a* decides the banknote feeding unit for feeding a banknote.

In the aforementioned description, two kinds of banknote feeding units (the banknote receiving unit 201*a* and the banknote cassette 30*a*) can be attached to the banknote accounting apparatuses 22 and 22X. However, not limited thereto, the present invention can be applied to a banknote accounting apparatus capable of receiving a banknote from three or more kinds of banknote feeding units.

As described above, the banknote handling apparatus 22 in this embodiment is capable of receiving a banknote from at least two kinds of banknote feeding units (e.g., the banknote receiving unit 201*a* and the banknote cassette 30*a*), and includes the apparatus-internal reject unit 224*a* configured to store a reject banknote inside the banknote handling apparatus 22, and the apparatus-external reject unit 222*a* configured to dispense a reject banknote to the outside of the banknote handling apparatus 22. In addition, the banknote handling apparatus 22 incudes the unit deciding part 260*a* configured to decide the banknote feeding unit for feeding a banknote, and the control unit 290*a* configured to decide, when the recognition unit 240*a* has recognized that a banknote having been received from the banknote feeding unit is a reject banknote, to which one of the apparatus-internal reject unit 224*a* and the apparatus-external reject unit 222*a* the reject banknote is transported, depending on the banknote feeding unit having fed the banknote.

According to such a banknote handling apparatus 22, depending on the banknote feeding unit having fed the banknote, whether the reject banknote is transported to the apparatus-internal reject unit 224*a* or the apparatus-external reject unit 222*a* is automatically decided. As a result, since it is not necessary for a user to instruct the transport destination of the reject banknote, the banknote accounting apparatus 22 can be easier to handle.

In addition, as described above, in the banknote handling apparatus 22 in this embodiment, the unit deciding part 260*a* decides the banknote feeding unit for feeding a banknote, based on a connection condition of the banknote feeding unit to the transport unit 230*a*. Thus, the unit deciding part 26 can decide the banknote feeding unit for feeding a banknote, without any instruction from a user.

In addition, as described above, the banknote handling apparatus 22 in this embodiment further includes the process reception unit (the operation display unit 295*a*, the cash management apparatus 25 and so on). Based on the process contents having been received by the process reception unit, the unit deciding part 260*a* decides the banknote feeding unit for feeding a banknote. Thus, when both the banknote receiving unit 201*a* and the banknote cassette 30*a* are simultaneously attachable, as in the case of the banknote handling apparatus 22X, a user can instruct whether a banknote is fed out from the banknote receiving unit 201*a* or the banknote cassette 30*a*, through the process reception unit.

In addition, as described above, in the banknote handling apparatus 22 in this embodiment, the banknote feeding unit incudes the banknote receiving unit 201*a* configured to receive a banknote(s) from outside and configured to feed, one by one, the banknotes, and the banknote cassette 30*a* configured to store a banknote(s) and configured to feed the banknotes stored therein.

In addition, as described above, in the banknote handling apparatus 22 in this embodiment, the control unit 290*a* performs a control process such that a reject banknote having been received from the banknote receiving unit 201*a* is transported to the apparatus-external reject unit 222*a*, and that a reject banknote having been received from the banknote cassette 30*a* is transported to the apparatus-internal reject unit 224*a*. Thus, even when a banknote in the banknote cassette 30*a* is a reject banknote, a person other than a user having a management authority cannot touch the reject banknote, whereby consistency in security can be ensured.

In addition, as described above, the banknote handling apparatus 22 in this embodiment further has the process reception unit (the operation display unit 295*a*, the cash management apparatus 25, etc.) configured to receive an instruction for process, and the control unit 290*a* performs a control process such that a reject banknote having been received from the banknote cassette 30*a* is transported to the apparatus-external reject unit 222*a*, depending on an instruction having been received by the process reception unit. Thus, when it is necessary to perform an irregular process that is different from an ordinary process, the banknote handling apparatus 22 can deal with the case. For example, when a user having a management authority wants to observe and confirm a reject banknote in the banknote cassette 30*a*, the banknote handling apparatus 22 can deal with the case.

It is desirable that the banknote cassette is attachable at a height where a user such as a clerk can easily operate the banknote cassette, and that a banknote can be manually deposited at such a height, while preventing enlargement of the banknote accounting apparatus. That is to say, it is desirable that a user can perform a depositing/dispensing process by the banknote cassette as well as a manual depositing/dispensing process, at substantially the same height, while maintaining a space of the banknote accounting apparatus as little as possible.

Next, in order to achieve the above object, there are described three embodiments (first to third embodiments) of the banknote handling apparatus 22 on which the banknote cassette 30*a* is attachable by moving the banknote receiving unit 201*a*.

In the first embodiment, the banknote receiving unit 201*a* is integrally formed with the banknote accounting apparatus 22, and is configured to be rotatable about a predetermined axis.

Figure 9B:
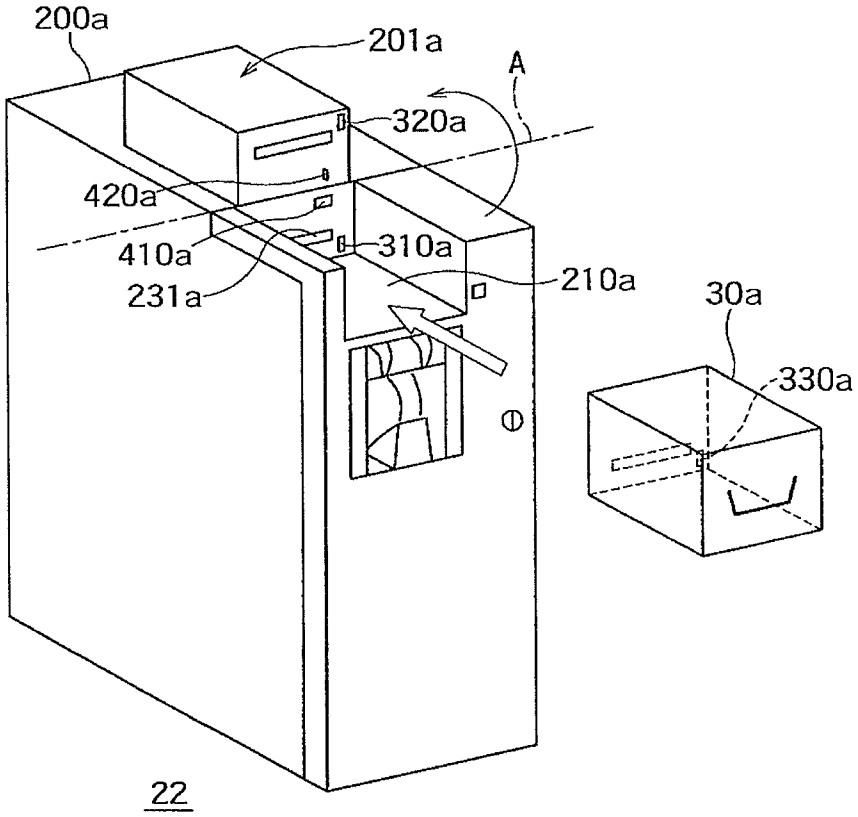
FIG. 9B is a perspective view of the banknote accounting apparatus 22 in a first embodiment.
Figure 9A:
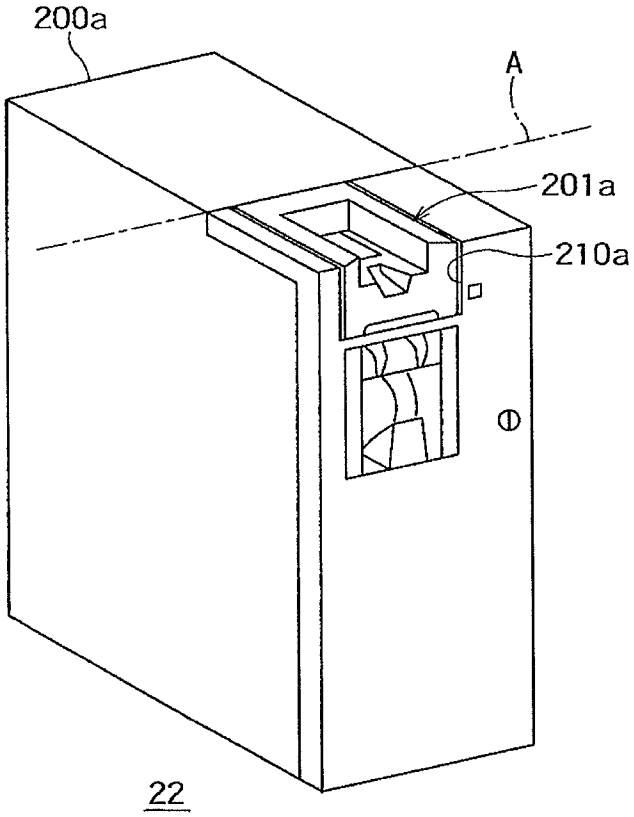

FIGS. 9A and 9B are perspective views of the banknote accounting apparatus 22 in this embodiment. FIG. 9A shows a condition where the banknote receiving unit 201*a* is attached to the depositing unit 210*a*, and FIG. 9B shows a condition where the banknote cassette 30*a* is being attached to the depositing unit 210*a*.

As shown in FIG. 9B, a unit connector 310*a* is disposed on the depositing unit 210*a*. The unit connector 310*a* is connected to a connector 320*a* of the banknote receiving unit 201*a*, or a connector 330*a* of the banknote cassette 30*a*.

In addition, as shown in FIG. 9B, a photo interrupter 410*a* is disposed on the depositing unit 210*a*. A light-shielding plate 42 configured to shield light from the photo interrupter 410*a* is disposed on the banknote receiving unit 210*a*. When the banknote receiving unit 201*a* is attached to the depositing unit 210*a* (see FIG. 9A), the light-shielding plate 420 shields light from the photo interrupter 410*a*.

As shown in FIGS. 9A and 9B, when the banknote cassette 30 in place of the banknote receiving unit 201*a* is attached, a set lock of the banknote receiving unit 201*a* is released, and the banknote receiving unit 201*a* is then brought up and rotated about the axis A, so that the banknote receiving unit 201*a* is withdrawn onto an upper surface of the housing 200*a*. At this time, the unit connector 310*a* and the connector 320*a* are disconnected from each other, and the light-shielding plate 420*a* is displaced from the photo interrupter 410*a*. Thus, the photo interrupter 410*a* becomes a floodlighting condition where light from a light emitting unit is received by a light receiving unit.

In the first embodiment, the banknote receiving unit 201*a* is rotated, so that a space for attaching the banknote cassette 30*a* is provided.

After the banknote receiving unit 201*a* has been withdrawn, as shown in FIG. 9B, the banknote cassette 30*a* is attached to the depositing unit 210*a*. At this time, since a width of the banknote cassette 30*a* and an interval between side surfaces of the depositing unit 210*a* are substantially the same with each other, a recessed part defined by a bottom surface and the side surfaces of the depositing unit 210*a* functions as a guide of the banknote cassette 30*a*.

When the cassette 30*a* is attached to the depositing unit 210*a*, the unit connector 310*a* and the connector 330*a* are connected to each other. The banknote cassette 30*a* is not provided with a light shielding plate such as the light shielding plate 420*a*. Thus, even when the banknote cassette 30*a* is attached to the depositing unit 210*a*, the photo interrupter 410*a* remains in the floodlighting condition.

In addition, positions of the banknote outlets of the banknote cassette 30*a* and the banknote receiving unit 201*a* correspond to a position of the end portion 231*a*, when the banknote cassette 30 or the banknote receiving unit 201*a* is attached to the depositing unit 210*a*. Thus, the banknote cassette 30*a* attached to the depositing unit 210*a* is connected to the transport unit 230*a*, so that a banknote having been fed out from the banknote cassette 30*a* can be transported into the apparatus by the transport unit 230*a*.

The aforementioned structure of the banknote receiving unit 201*a* other than the withdrawal manner is the same as structures in the second and third embodiments.

In the first embodiment, the banknote receiving unit 201*a* is rotated so as to be withdrawn, and the banknote cassette 30*a* is attached to the place where the banknote receiving unit 201*a* has been attached. Thus, it is not necessary to provide an additional space for attaching the banknote cassette 30*a*. In addition, a depositing/dispensing process by the banknote cassette and a manual depositing/manual dispensing process can be performed at substantially the same height.

Further, a banknote having been fed out from the banknote cassette 30*a* is transported from the end portion 231*a* of the transport unit 230*a* into the apparatus, similarly to a banknote having been fed out from the banknote receiving unit 201*a*. Thus, it is not necessary to additionally provide a transport path for transporting a banknote having been received from the banknote cassette 30*a* into the apparatus.

Namely, the banknote accounting apparatus in the first embodiment can deal with both a depositing/dispensing process by the banknote cassette, and a manual depositing/dispensing process. The depositing/dispensing process by the banknote cassette and the manual depositing/dispensing process can be performed a substantially the same height, while a space is saved.

In the below-described second embodiment, the banknote receiving unit 201*a* is integrally formed with the banknote accounting apparatus 22, and is configured to be vertically translatable by a moving mechanism.

Figure 10B:
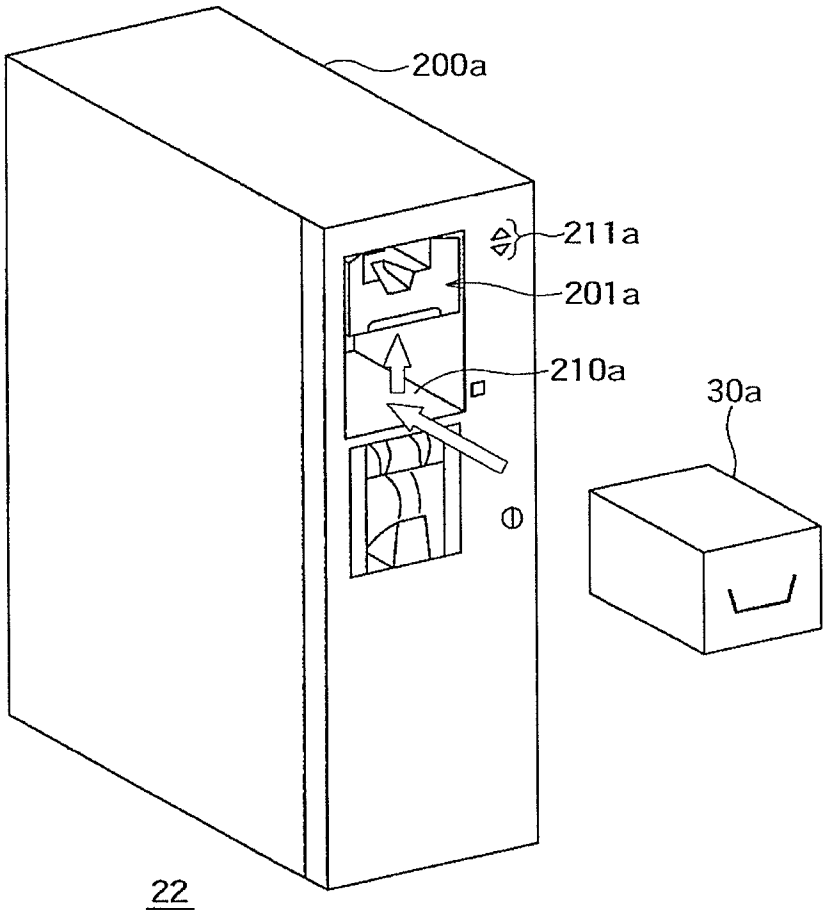
FIG. 10B is a perspective view of the banknote accounting apparatus 22 in a second embodiment.
Figure 10A:
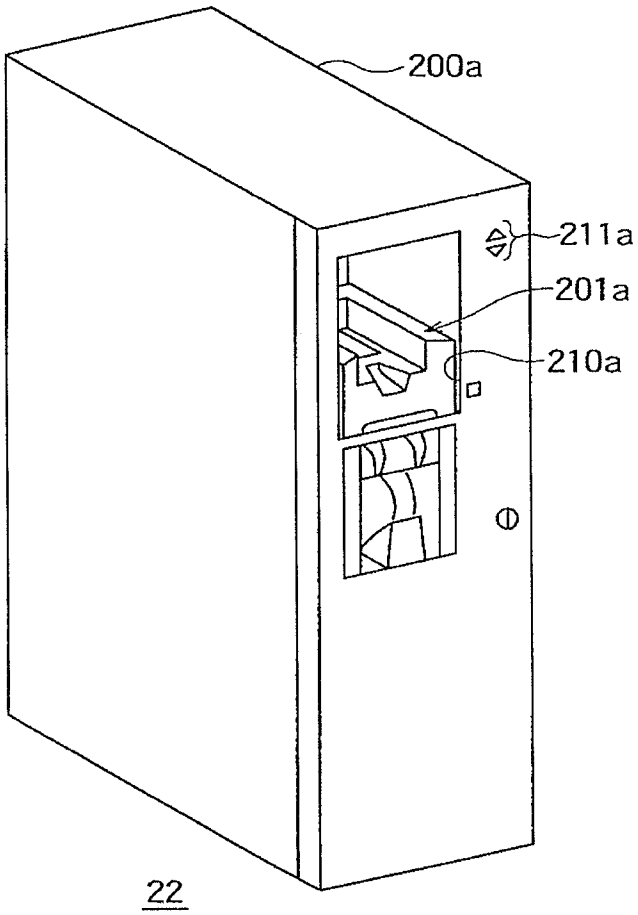

FIGS. 10A and 10B are perspective views of the banknote accounting apparatus 22 in the second embodiment. FIG. 10A shows a condition where the banknote receiving unit 201*a* is attached to the depositing unit 210*a*, and FIG. 10B shows a condition where the banknote cassette 30*a* is being attached to the depositing unit 210*a*.

As shown in FIGS. 10A and 10B, when the banknote cassette 30*a* in place of the banknote receiving unit 201*a* is attached, the banknote receiving unit 201*a* is translated upward so as to be withdrawn to an upper side of the housing 200*a*. For example, by pressing down a button 211*a* for operating a moving mechanism (not shown) configured to vertically translate the banknote receiving unit 201*a*, the banknote receiving unit 201*a* is withdrawn to the upper side of the housing 200*a*. Namely, in the second embodiment, the banknote receiving unit 201*a* is translated, so that a space for attaching the banknote cassette 30*a* is provided.

After the banknote receiving unit 201*a* has been withdrawn, as can be understood from FIG. 10B, the banknote cassette 30*a* is attached to the depositing unit 210*a*. Thus, the banknote cassette 30*a* is connected to the transport unit 230*a*, whereby a banknote having been fed out from the banknote cassette 30*a* can be transported into the apparatus by the transport unit 230*a*.

As can be understood from above, also in the second embodiment, the same effect as that of the first embodiment can be obtained. Further, according to the second embodiment, it is not necessary to make room on the upper surface of the housing 200*a* as a withdrawal space of the banknote receiving unit 201*a*. Thus, it is possible to increase a space on the upper surface of the housing 200*a* where an equipment such as a printer and a card reader can be placed.

In the below-described third embodiment, the banknote receiving unit 201*a* is configured to be attachable to and detachable from the banknote accounting apparatus 22.

Figure 11B:
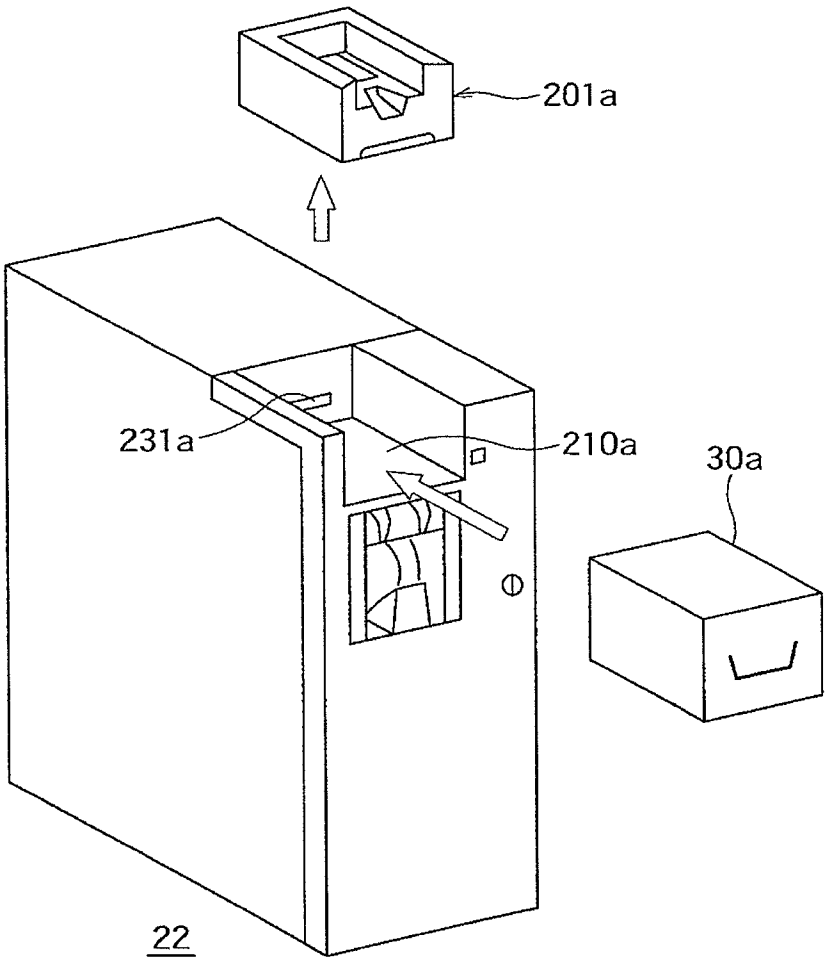
FIG. 11B is a perspective view of the banknote accounting apparatus 22 in a third embodiment.
Figure 11A:
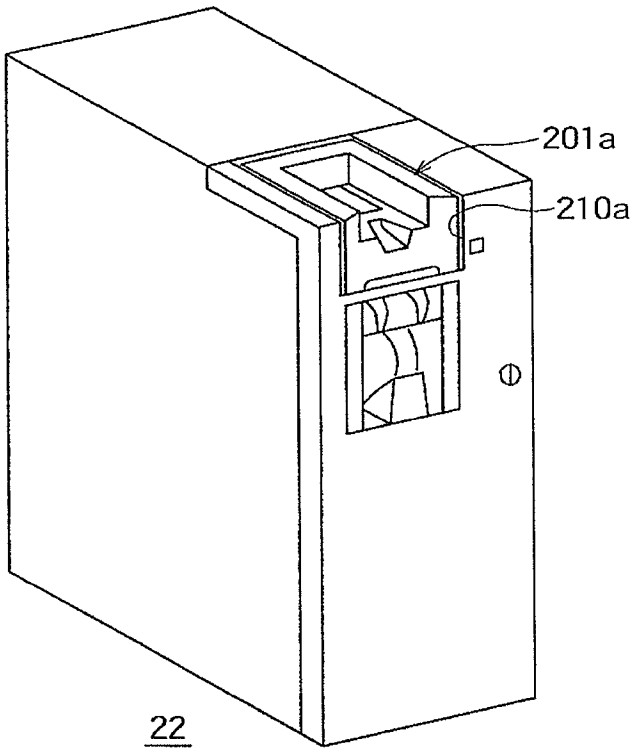

FIGS. 11A and 11B are perspective views of the banknote accounting apparatus 22 in the third embodiment. FIG. 11A shows a condition where the banknote receiving unit 201*a* is attached to the depositing unit 210*a*, and FIG. 11B shows a condition where the banknote cassette 30*a* is being attached to the depositing unit 210*a*.

As shown in FIGS. 11A and 11B, when the banknote cassette 30*a* in place of the banknote receiving unit 201*a* is attached, the banknote receiving unit 201*a* is detached from the banknote accounting apparatus 22 so as to be withdrawn. Namely, in the third embodiment, the banknote receiving unit 201*a* is detached from the banknote accounting apparatus 22, so that a space for attaching the banknote cassette 30*a* is provided.

After the banknote receiving unit 201*a* has been withdrawn, as can be understood from FIG. 11B, the banknote cassette 30 is attached to the depositing unit 210*a*. Thus, the banknote cassette 30*a* is connected to the transport unit 230*a*, whereby a banknote having been fed out from the banknote cassette 30*a* can be transported into the apparatus by the transport unit 230*a*.

As can be understood from above, also in the third embodiment, the same effect as that of the second embodiment can be obtained.

As described above, the banknote handling apparatus 22 in this embodiment includes the transport unit 230*a* configured to receive a banknote from the end portion 231*a* and configured to transport the banknote into the banknote handling apparatus 22, and a banknote-feeding-unit connecting unit (depositing unit) 210*a* configured such that at least two kinds of banknote feeding units (e.g., the banknote receiving unit 201*a* and the banknote cassette 30*a*) can be attached thereto, the banknote-feeding-unit connecting unit being configured to connect the banknote feeding unit and the transport unit 230*a* to each other, such that a banknote having been fed out from the banknote feeding unit is transported from the end portion 231*a* of the transport unit 230*a*.

Due to such a structure, according to the banknote handling apparatus 22 in this embodiment, a banknote having been fed out from the banknote feeding unit is transported from the end portion 231*a* of the transport unit 230*a* into the apparatus, irrespective of the kind of the banknote feeding unit attached to the depositing unit 210*a*. Thus, it is not necessary to additionally provide a transport path for transporting a banknote having been fed out from the banknote cassette 30*a* into the apparatus. As a result, a cost required for the banknote handling apparatus 22 can be reduced.

In addition, as described above, in the banknote handling apparatus 22 in this embodiment, the banknote feeding units are the banknote receiving unit 201*a* configured to receive a banknote(s) from outside and configured to feed, one by one, the banknotes, and the banknote cassette 30*a* configured to store a banknote(s) therein and configured to feed out the banknote stored therein.

In addition, as described above, in the banknote handling apparatus 22 in this embodiment, the banknote receiving unit 201*a* is integrally formed with the banknote handling apparatus 22. The banknote receiving unit 201*a* is configured to be movable between a first position at which the banknote receiving unit 201*a* is connected to the transport unit 230*a* and a second position at which the banknote receiving unit 201*a* is disconnected from the transport unit 230*a*. When the banknote receiving unit 201*a* is placed on the second position, the banknote cassette 30*a* is attachable to the first position.

Due to such a structure, according to the banknote handling apparatus 22 in this embodiment, it is not necessary to provide an additional space for attaching the banknote cassette 30*a*. In addition, a banknote having been fed out from the banknote cassette 30*a* attached to the depositing unit 201*a* is transported from the end portion 231*a* of the transport unit 230*a* into the apparatus, similarly to a banknote having been fed out from the banknote receiving unit 201*a*. Further, since a user can perform a depositing process by the banknote receiving unit 201*a* and a depositing process by the banknote cassette 30*a* at the same height, it is easy to use the banknote handling apparatus 22.

In addition, in the banknote handling apparatus 22 in this embodiment, as described with reference to FIGS. 11A and 11B, the banknote receiving unit 201*a* may be configured to be attachable to and detachable from the banknote handling apparatus 22.

Based on the above description, those skilled in the art can come up with additional effects and various modifications of the present invention, but the present invention is not limited to the aforementioned embodiments. The present invention can be variously added, modified and partially deleted, without departing from a scope of the claims and a conceptual idea of the present invention derived from an equivalence.

1 Cash management system
10 Checkout counter
11 Cash settlement apparatus
12 Banknote settlement apparatus
13 Coin settlement apparatus
14 Register
20 Back office
21 Cash accounting apparatus
22 Banknote accounting apparatus
23 Coin accounting apparatus
25 Cash management apparatus
26 POS management apparatus
30 Cash transport cassette
30*a* Banknote cassette
200*a* Housing
201*a* Banknote receiving unit
210*a* Depositing unit
220*a* Dispensing unit
222*a* Apparatus-external reject unit
224*a* Apparatus-internal reject unit
230*a* Transport unit
231*a* End portion
240*a* Recognition unit
242*a* Sensor
250*a* Storing unit
254*a* Collecting and stacking unit
255*a* Collecting unit
260*a* Unit deciding part
270*a* Memory
280*a* Communication unit
290*a* Control unit
295*a* Operation display unit
310*a* Unit connector
320*a*, 330*a* Connector
410*a* Photo interrupter
420*a* Light shielding plate

What is claimed is:

1. A banknote handling apparatus comprising:

a housing;

a depositing portion arranged at the housing for depositing a banknote from outside into the housing therethrough;

a banknote receiving unit configured to receive a banknote from outside of the housing therein and feed out the received banknote into the housing through the depositing portion, the banknote receiving unit being fixed to the depositing portion, rotatable about a predetermined axis, and movable upward or downward;

a connecting unit configured to detachably attach, to the housing, one of the banknote receiving unit and a cassette which is configured to store a banknote therein and feed out the banknote therefrom, and is capable of being attached to and detached from the apparatus to another apparatus for transporting the banknote stored therein, the connecting unit being arranged at the depositing portion and through which the banknote fed from the banknote receiving unit or the cassette is transported;

a transport unit configured to transport the banknote fed out from the banknote receiving unit or the cassette attached to the connecting unit into the banknote handling apparatus through the connecting unit; and a moving mechanism configured to rotate the banknote receiving unit about the predetermined axis and to move the banknote receiving unit upward or downward for attaching the banknote receiving unit to the connecting unit or detaching the attached banknote receiving unit from the connecting unit.

2. The banknote handling apparatus according to claim 1, further comprising a recognition unit configured to recognize at least a denomination of the banknote being transported by the transport unit, wherein the recognition unit recognizes both the banknote having been fed out from the banknote receiving unit and the banknote having been fed out from the cassette.

3. The banknote handling apparatus according to claim 2, wherein the banknote having been fed out from the banknote receiving unit is transported to the recognition unit along a first transport path, and the banknote having been fed out from the cassette is transported to the recognition unit along the first transport path.

4. The banknote handling apparatus according to claim 1, further comprising:

a process reception unit configured to receive an instruction for deposit processing, wherein the banknote receiving unit feeds out the banknote received in the banknote receiving unit to the transport unit by receiving the instruction for the deposit processing by the process reception unit when the banknote receiving unit is attached to the connecting unit, and the cassette feeds out the banknote stored in the cassette to the transport unit by receiving the instruction for the deposit processing by the process reception unit when the cassette is attached to the connecting unit.

5. The banknote handling apparatus according to claim 1, wherein a first connector is disposed at the connecting unit, and the first connector is connected to a second connector disposed at the banknote receiving unit via a driving power source line or a signal line when the banknote receiving unit is attached to the connecting unit.

6. The banknote handling apparatus according to claim 1, wherein the banknote receiving unit is movable between a first position at which the banknote receiving unit is connected to the transport unit and a second position at which the banknote receiving unit is disconnected from the transport unit by the moving mechanism, and when the banknote receiving unit is placed in the second position, the cassette is attachable to the transport unit at the first position.

7. The banknote handling apparatus according to claim 1, wherein the banknote receiving unit is configured to move vertically.

8. The banknote handling apparatus according to claim 1, wherein the connecting unit is disposed on an end portion of the transport unit.

9. The banknote handling apparatus according to claim 1, wherein the cassette comprises a memory unit configured to store information on the banknote stored in the cassette and an identification information for specifying the cassette, and when the cassette is attached to the connecting unit, the banknote handling apparatus is capable of accessing the memory unit through the connecting unit.

10. The banknote handling apparatus according to claim 1, wherein when the moving mechanism moves the banknote receiving unit upward to the upper side of the housing and detaches the banknote receiving unit from the connecting unit, the connecting unit is capable of connecting the cassette storing a banknote therein to the transport unit for feeding out the banknote stored in the cassette to the transport unit through the connecting unit, and when the moving mechanism moves the banknote receiving unit downward and attaches the banknote receiving unit to the connecting unit, the banknote receiving unit is capable of receiving the banknote from outside of the housing and feeding out the received banknote into the housing.

* * * * *